US009873605B2

(12) United States Patent
Santy et al.

(10) Patent No.: US 9,873,605 B2
(45) Date of Patent: Jan. 23, 2018

(54) POST-MIX DISPENSER ASSEMBLY

(71) Applicant: Schroeder Industries, Inc., San Antonio, TX (US)

(72) Inventors: David Santy, Converse, TX (US); A.A. Jud Schroeder, San Antonio, TX (US); Deborah Absalon, Converse, TX (US)

(73) Assignee: Schroeder Industries, Inc., San Antonio, TX (US)

( * ) Notice: Subject to any disclaimer, the term of this patent is extended or adjusted under 35 U.S.C. 154(b) by 0 days.

(21) Appl. No.: 14/294,271

(22) Filed: Jun. 3, 2014

(65) Prior Publication Data

US 2014/0299627 A1 Oct. 9, 2014

Related U.S. Application Data

(63) Continuation of application No. 12/693,916, filed on Jan. 26, 2010, now abandoned.

(60) Provisional application No. 61/206,065, filed on Jan. 27, 2009, provisional application No. 61/260,097, filed on Nov. 11, 2009.

(51) Int. Cl.

| | |
|---|---|
| ***B67D 1/00*** | (2006.01) |
| ***B67D 1/14*** | (2006.01) |
| ***B67D 1/16*** | (2006.01) |
| ***B67D 1/06*** | (2006.01) |

(52) U.S. Cl.

CPC ..... *B67D 1/0082* (2013.01); *B67D 1/005* (2013.01); *B67D 1/0021* (2013.01); *B67D 1/0044* (2013.01); *B67D 1/06* (2013.01); *B67D 1/1466* (2013.01); *B67D 1/16* (2013.01); *B67D 2001/0094* (2013.01); *B67D 2210/00031* (2013.01); *B67D 2210/00034* (2013.01)

(58) Field of Classification Search

CPC .. B67D 1/0021; B67D 1/0044; B67D 1/0085; B67D 1/005; B67D 1/0082; B67D 1/06; B67D 1/1466; B67D 1/16

USPC ..... 222/78, 108, 129.1–129.4, 173, 145.5, 222/144.5

See application file for complete search history.

(56) References Cited

U.S. PATENT DOCUMENTS

| | | | | |
|---|---|---|---|---|
| 2,733,730 A * | 2/1956 | Turak | B67D 1/0083 | 137/505.13 |
| 2,888,040 A * | 5/1959 | Terwilliger et al. | 137/635 | |
| 3,710,981 A * | 1/1973 | Arzberger et al. | 222/129.1 | |
| 3,948,419 A * | 4/1976 | Polster | B67D 1/1234 | 137/505.13 |

(Continued)

FOREIGN PATENT DOCUMENTS

| | | |
|---|---|---|
| WO | 2002090241 | 11/2002 |
| WO | 2003024862 | 3/2003 |

(Continued)

*Primary Examiner* — Charles P Cheyney
(74) *Attorney, Agent, or Firm* — Jackson Walker LLP

(57) ABSTRACT

A beverage dispensing assembly which has one or more urns to which a manual, post-mix valve is engaged, on front walls thereof. The urn or urns do not contain fluid, rather, at least, a pair of fluid lines carrying pressurized fluid to the post-mix valve, which may be a "T" valve. The two fluid lines carry fluid from a first and a second fluid source, typically pressurized, which sources are remote from the urn or urns. If the assembly is comprised of more than one urn, it may include a base, designed to hold the urns in side-by-side alignment.

17 Claims, 19 Drawing Sheets

(56) References Cited

U.S. PATENT DOCUMENTS

| | | | | |
|---|---|---|---|---|
| 4,549,675 | A * | 10/1985 | Austin | B67D 1/0082 137/607 |
| 4,619,378 | A | 10/1986 | de Man | |
| 4,986,449 | A * | 1/1991 | Valiyee | B67D 1/0084 137/606 |
| 5,002,204 | A * | 3/1991 | Sakai | B67D 1/07 204/275.1 |
| 5,190,188 | A * | 3/1993 | Credle, Jr. | 222/1 |
| 5,269,442 | A * | 12/1993 | Vogel | 222/129.1 |
| 5,305,924 | A * | 4/1994 | Groover et al. | 222/129.1 |
| 5,601,210 | A * | 2/1997 | Kelly | B67D 1/0082 137/625.4 |
| 5,881,917 | A * | 3/1999 | Jones et al. | 222/129 |
| 5,931,348 | A * | 8/1999 | Guadalupi | 222/129.1 |
| 6,112,946 | A | 9/2000 | Bennett et al. | |
| 6,196,422 | B1 | 3/2001 | Tuyls et al. | |
| 6,234,354 | B1 * | 5/2001 | Phillips et al. | 222/129.1 |
| 6,260,477 | B1 | 7/2001 | Tuyls et al. | |
| 6,269,973 | B1 | 8/2001 | Bennett et al. | |
| 6,405,897 | B1 | 6/2002 | Jepson et al. | |
| 6,463,753 | B1 | 10/2002 | Haskayne | |
| 6,644,508 | B2 | 11/2003 | Haskayne | |
| 6,672,849 | B1 | 1/2004 | Martindale et al. | |
| 6,698,229 | B2 | 3/2004 | Renken | |
| 6,722,527 | B1 | 4/2004 | Krauss | |
| 6,725,687 | B2 | 4/2004 | McCann et al. | |
| 6,761,036 | B2 | 7/2004 | Teague | |
| 6,792,847 | B2 * | 9/2004 | Tobin et al. | 99/275 |
| 6,832,487 | B1 | 12/2004 | Baker | |
| 6,883,685 | B2 * | 4/2005 | Jones et al. | 222/146.5 |
| 6,945,070 | B1 | 9/2005 | Jablonski | |
| 7,021,077 | B2 | 4/2006 | Schroeder | |
| 7,025,230 | B1 | 4/2006 | Salmela | |
| 7,048,148 | B2 | 5/2006 | Roekens | |
| 7,070,068 | B2 * | 7/2006 | Fox | 222/129.1 |
| 7,080,937 | B1 | 7/2006 | Salmela et al. | |
| 7,232,044 | B1 | 6/2007 | Salmela | |
| D549,021 | S | 8/2007 | Tuyls et al. | |
| 7,266,974 | B2 | 9/2007 | Schroeder | |
| 7,305,847 | B2 | 12/2007 | Wolski | |
| 7,311,226 | B2 | 12/2007 | Kado et al. | |
| 7,337,618 | B2 | 3/2008 | Wolski | |
| 7,337,627 | B2 | 3/2008 | Wolski | |
| 7,373,784 | B2 | 5/2008 | Haskayne | |
| 7,384,073 | B1 | 6/2008 | Tuyls et al. | |
| 7,448,418 | B1 | 11/2008 | Tuyls | |
| 7,762,421 | B2 | 7/2010 | Tuyls et al. | |
| D626,373 | S | 11/2010 | Valiyee et al. | |
| D626,374 | S | 11/2010 | Valiyee et al. | |
| D626,375 | S | 11/2010 | Valiyee et al. | |
| D628,014 | S | 11/2010 | Martindale | |
| 7,931,382 | B2 | 4/2011 | Hecht | |
| D638,659 | S | 5/2011 | Martindale et al. | |
| D643,708 | S | 8/2011 | Hecht | |
| D647,785 | S | 11/2011 | Hecht | |
| D648,420 | S | 11/2011 | Hecht | |
| D648,421 | S | 11/2011 | Hecht | |
| D648,617 | S | 11/2011 | Hecht | |
| D648,826 | S | 11/2011 | Hecht | |
| 2003/0071060 | A1 | 4/2003 | Haskayne | |
| 2006/0162370 | A1 | 7/2006 | Haskayne | |
| 2008/0135426 | A1 | 6/2008 | Hecht et al. | |
| 2008/0217357 | A1 | 9/2008 | Hecht | |
| 2009/0078722 | A1 | 3/2009 | Salmela | |
| 2009/0090747 | A1 | 4/2009 | Tyuls et al. | |
| 2009/0145927 | A1 | 6/2009 | Salmela et al. | |
| 2009/0230148 | A1 | 9/2009 | Valiyee et al. | |
| 2010/0097881 | A1 | 4/2010 | Tuyls et al. | |
| 2010/0116842 | A1 | 5/2010 | Hecht et al. | |
| 2010/0147886 | A1 | 6/2010 | Martindale | |
| 2010/0314411 | A1 | 12/2010 | Tuyls et al. | |
| 2011/0057134 | A1 | 3/2011 | Martindale et al. | |
| 2011/0073617 | A1 | 3/2011 | Martindale et al. | |
| 2011/0286883 | A1 | 12/2011 | Hecht et al. | |
| 2011/0315711 | A1 | 12/2011 | Hecht et al. | |

FOREIGN PATENT DOCUMENTS

| | | |
|---|---|---|
| WO | 2006088990 | 8/2006 |
| WO | WO 2007091122 A2 * | 8/2007 |
| WO | WO2009090429 | 7/2009 |

* cited by examiner 10
12A
12B
14A
14B
16A
16B
18A
18B
20
22
24
26
27
28
30
32
34
36
38
40
40a
41
42
44
46
48
50
51
52
54
56
57
58
60
62
W
S
"A"
"B"
"C"
$S_1$
$S_2$
$S_3$
$S_4$

SECTION A-A

SECTION D-D

SECTION E-E

SECTION A - A

SECTION C-C

SECTION D-D

DETAIL F
SCALE 2:1

SECTION E-E

POST-MIX DISPENSER ASSEMBLY

This application is a continuation of and claims the benefit of, incorporates by reference, and priority from U.S. patent application Ser. No. 12/693,916, filed Jan. 26, 2010; U.S. Provisional Patent Application Ser. No. 61/206,065, filed Jan. 27, 2009, and U.S. Provisional Patent Application Ser. No. 61/260,097, filed Nov. 11, 2009. This application incorporates by reference U.S. patent application Ser. No. 12/286,441 (now U.S. Pat. No. 8,123,079).

FIELD OF THE INVENTION

Dispenser assemblies, more specifically, a post-mix dispenser assembly comprising one or a multiple substantially identical urn assemblies and valves, namely, post-mix valves.

BACKGROUND OF THE INVENTION

Psychologically, customers for dispensed beverages prefer their beverage "fresh brewed." For example, most consumers prefer fresh brewed tea, rather than tea that is mixed upon dispensing. That is to say, tea that is mixed upon dispensing (syrup and water mixing when the drink is being dispensed) is less preferred than tea dispensed as brewed (pre-mixed).

However, pre-mixed beverages have a limited shelf-life. While the customer prefers, generally, pre-mixed beverages, those pre-mixed beverages must be fresh due to their limited shelf life. Circumstances often dictate that freshness is not achievable and post-mix dispensing is called for.

Thus, utility would be achieved in providing an assembly for dispensing that gave the appearance of dispensing a pre-mix fluid, yet in fact was dispensing a post-mixed beverage.

Most consumers are familiar with an urn, such as an urn for containing tea or coffee or other pre-mixed beverage, which urn has a generally "T"-shaped faucet or valve, which may be near the middle or top of the urn. The "T"-shaped faucet or valve may have a leg, and two arms coming off the leg, the leg for providing fluid communication to the liquid in the urn, one arm coming up from the leg providing a pivoting valve or handle, which the user pivots typically forward to provide flow from the descending arm of the "T" valve or "T" faucet.

The average consumer is familiar with the use of the single urn with a single manual T valve for dispensing pre-mixed beverages, such as tea or coffee, therefrom. Psychologically, the single valve, single urn assembly triggers a connection in the user's mind that they are obtaining a pre-mixed (and therefore presumably fresh) beverage.

On the other hand, consumers are also familiar with a post-mix dispensing unit, such as those often found in movie theaters or fastfood establishments, wherein as many as a half dozen different soda flavors, each with its own valve and lever, are provided with ice and wherein the user puts it under the selected beverage choice and urges the cup against the lever. Using these units, the consumer here knows he is not getting pre-mixed beverages, as he can often see the mixing occur right at the nozzle and as the syrup and carbonated water flow into the cup.

Most post-mix dispensers appear to be exactly what they are and do not endeavor to disguise the fact that the drink is not pre-mixed. However, at least from a psychological point of view, benefits are available in providing the convenience of post-mixed beverage with the appearance of pre-mixed coming from an urn or urns.

Post-mix valves are known in the art to provide for mixing of a first fluid and a second fluid after the two fluids have been valved and are flowing, for example, in bar guns. The post-mix dispensing valves known in the art, however, typically provide for pistons or stems in which the upstream pressurized fluid works against the spring or the closure mechanisms in the valve. That is to say, prior art valves are arranged such that the upstream valved fluid will be working to unseat the stem or piston controlling the flow of the pressurized fluid between upstream and downstream of the valve.

Further, post-mix valves known in the art typically do not mix a first and second fluid in the nozzle from a "T" or Tea valve. The term Tea or "T" valve generally refers to a valve having the configuration of handle, body, nozzle along a vertical axis with fluid lines coming into this assembly horizontally between the handle and nozzle (see FIGS. 9A and 9A).

OBJECT OF THE INVENTION

It is an object of the present invention to provide for a post-mix dispenser "disguised" as a pre-mix dispenser urn for the effective dispensing of one or a multiple different post-mix beverages from a single or a multiple urn dispensing assembly.

It is an object of the invention to provide, in one embodiment of a manually operated post-mix valve, a manually operated post-mix Tea valve in which the upstream pressurized fluid therein will urge a normally closed, seated piston or stem into the seated fluid flow blocking position, which normally closed seated position prevents the flow of pressurized fluid therethrough.

It is another object of the present invention to provide for a Tea valve having two fluid lines entering the valve, which valve is manually operated from a generally, but not necessarily, vertical handle to release the pressurized fluids in the two lines for mixing in a nozzle downstream of the valve, which nozzle is spaced apart but generally vertically aligned with the handle.

It is a further object of the present invention to provide a post-mix Tea valve for mixing a pair of fluids in a nozzle of the Tea valve, which Tea valve is engaged to an urn, which urn is adapted to receive a pair of fluid lines, but which fluid sources are not the urn itself, but rather are remotely located.

It is a further object of the present invention to provide for a nozzle assembly which can provide for more complete mixing of a first and second fluid on the inside walls of a nozzle housing.

SUMMARY OF THE INVENTION

Applicant provides a post-mixed dispenser comprising one or a multiplicity of substantially identical, modular, urn assemblies wherein each urn assembly includes a single discrete substantially consumer visible urn with a single discrete mechanical (non-electrical) dispensing valve, the valve configured to operate and dispense a post-mix beverage wherein, when there is a multiplicity of urns, each urn, typically having at least side walls, a front wall, and a back wall, lays adjacent another urn, the urns and dispensing valves typically aligned.

Applicant further provides a true mechanical post-mix "T" dispensing valve, that is to say, a post-mix "T" dispensing valve that will mix syrup and water (sometimes carbonated or soda water) in the nozzle cover or housing of the valve.

Applicant also provides for a modular assembly with urns engageable with a base to support the urns, which base is configured to receive, typically, two, three, four or more of the substantially identical urns in side-by-side alignment, each with the post-mix "T" dispensing valve, typically mechanical, engaged therewith, which urns in fact are not configured to accept a liquid, (i.e., may have openings below the valve level from which fluid could escape), but rather are configured to accept a flow control assembly.

Applicant provides a modular urn assembly for accepting water from a water line, wherein no water regulator is generally required and wherein no electrical parts are required (as, for example, in an electrical solenoid operated flow control valve), and an urn assembly with very few moving parts.

Applicant's urn assembly may include a base having a drip tray removable therefrom for easy emptying, which drip tray typically includes a cutout removable therefrom to allow easy and convenient hookup to a drain line.

Applicant's novel urn assembly typically includes syrup and water lines that may enter the dispenser through either the countertop (lines entering the bottom of the base), or the rear of the base or the rear of the urn.

Applicant's novel urn assembly typically includes individual fluid (water and syrup) flow control assemblies or valves in one or each of the multiple urns thereof, which have manual shutoff flow control are easy to service if required and include a flow control valve as a module adapted for removable without tools. In an embodiment of Applicants' novel "T" valve, a pair of fluid bearing lines enter a valve body. The valve body has a vertical axis and a pair of piston/stems acting vertically. A handle extends upward from the piston/stems and the chambers that they operate in and a nozzle extends downward therefrom. Operating the vertical handle dispenses the fluids separately into a nozzle, where diverter plates spread the first fluid and the second fluid separately onto the inside wall of a nozzle housing where the first or second fluid may mix prior to being dispensed from the nose of the nozzle.

DETAILED DESCRIPTION OF THE PREFERRED EMBODIMENT

Figure 1:
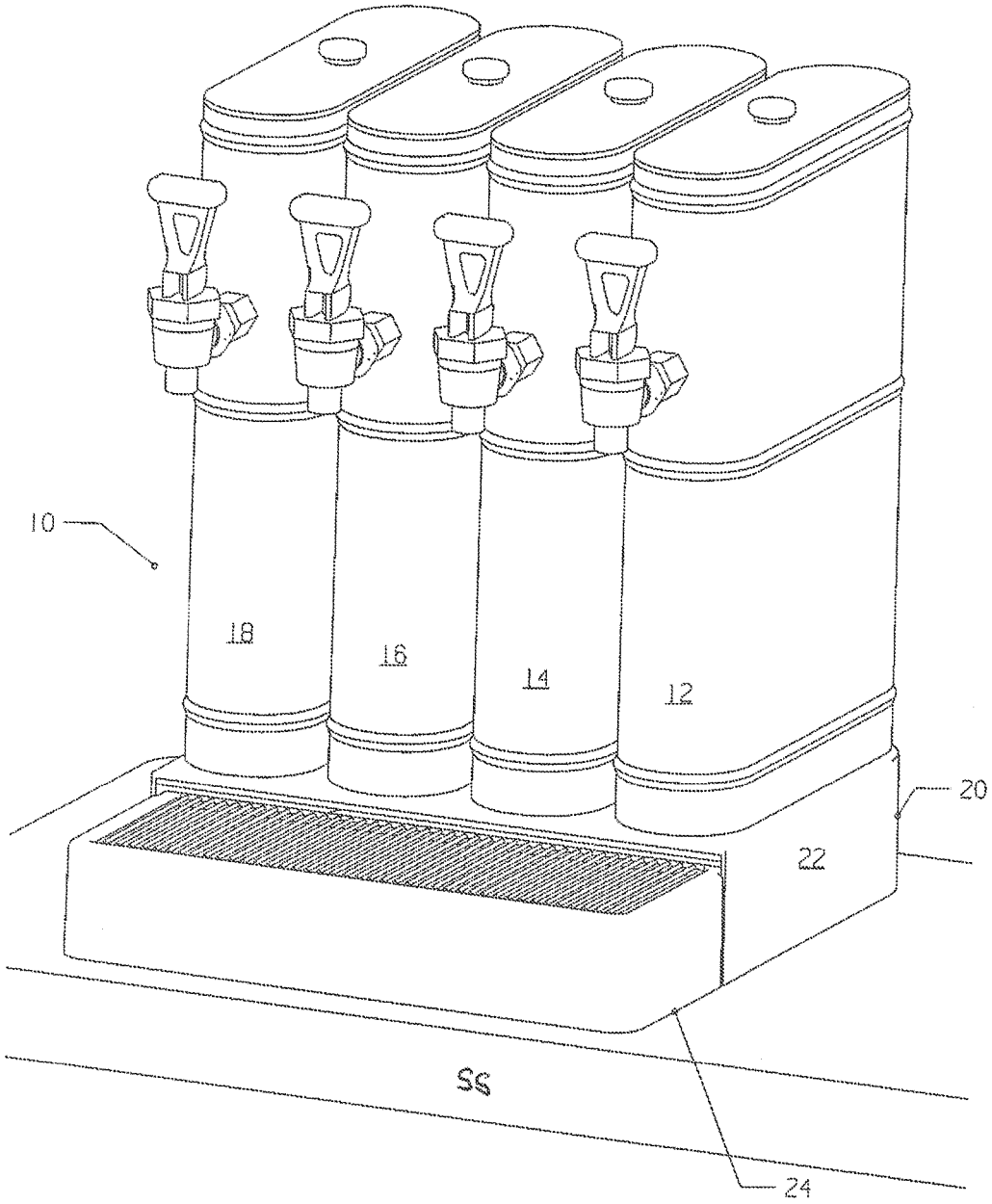
FIG. 1 is an illustration, in perspective view, of Applicant's post-mix dispenser or urn assembly.

FIGS. 1 through 5 illustrate Applicant's urn assembly 10, it being seen to include, in this example four urns 12/14/16/18 each typically including a lid 12A, 14A, 16A, 18A which lid may optionally also include a knob 12B, 14B, 16B and 18B. A base assembly 20 is provided for vertical support, the base assembly having walls 22 for providing vertical support to the urn or urns and dimensioned for receiving and maintaining at least one urn or if two or more urns in side-by-side relation and aligned as seen in the accompanying figures. A drip tray assembly 24 may be integral with or may engage, in ways known in the trade, walls 22 and a drip line 26 may be provided in a knock-out portion of the drip tray assembly 24. A grate 27 may also be provided as part of the drip tray assembly 24 for draining fluid in a manner known in the art.

As can be seen in the accompanying illustration, urn assemblies are attached to typically mechanical "T" valves 28/30/32/34, each which contains a nozzle housing 36 (typically removable), and a handle 38.

A single water line 40 is typically provided entering base assembly 20 or urn either at the rear thereof (for example see FIG. 3, elements B and C) or at the bottom of the base assembly (coming up from below through the countertop, element A, FIG. 3). As used herein, water line refers to a line carrying water, soda water or any other base fluid. In any case, the base assembly may have walls cut out for receiving the water and syrup lines. Water line 40 may go into a manifold 41, which manifold may be located within an interior of base assembly 20 and which will provide a multiplicity of water lines to a multiplicity of flow control valve assemblies as set forth below. A manifold may be eliminated and multiple urns will have multiple water and syrup lines—4 urns; 4 water and syrup lines. This will allow, for example, multiple, different base fluids. The water line and syrup lines 42, 44, 46 and 48 are illustrated to show engagement of urn assembly 10 with a water source "W" and, here four syrup sources $S_1$, $S_2$, $S_3$ and $S_4$.

The syrup sources may be pressurized tanks or cylinders or bag in a box as known in the art. In any case, there is typically multiple sources of syrup and a single water line. Lines enter the urn assembly, with, typically a water line 40 going to a manifold and each of the syrup lines 42/44/46/48 from the sources $S_1/S_2/S_3/S_4$ to flow control valve assemblies 50. Flow control valve assemblies are typically mechanical in nature (as opposed to electronic) and, as known in the art, include a flow control valve 52 for water (or other base fluid) and a flow control valve for syrup 54. Flow control valve assemblies might be mounted on brackets 57 which engage the inner walls of the urn. Further, the flow control valve assembly 50 typically includes a shutoff valve 56 for water and a shutoff valve 58 for syrup. Lines designated with numeral 60 is water coming out of the flow control valve and with numeral 62 is syrup coming out of the flow control valve.

As can be seen from the illustrations, the urns are not adapted to contain fluid within the walls—that is they are not fluid containers (although they appear that way externally), instead they typically contain at least water and syrup lines and typically each one a flow control valve assembly. The flow control valve assembly is typically placed within the interior of the urn and has a water and a syrup line coming into the flow control valve assembly and a water and a syrup line coming out of the flow control valve assembly and into the "T" valve that is associated with the individual urn.

The "T" handle or faucet 28/30/32/34 typically includes a generally upstanding (does not have to be perpendicular) handle portion 38 that is recognized by consumers, the movement of which will activate a post-mix assembly within the valve such that the soda and syrup will mix in the nozzle portion 36 of the valve when the handle is moved.

As seen from the illustrations, Applicant's urn assembly 10 comprises multiple substantially identical urns. In a preferred embodiment, mechanical flow control valves (meaning no electricity) are used and there are multiple units typically set side-by-side with one flow control valve assembly and one post-mix valve per urn. Moreover, the flow control valve assembly is typically adapted to, as by bracketry and the like, to be removably inserted within the interior of the urn and so that the water and syrup line engaging the flow control valve assembly and the "T" valve may do so in a removable "plug-in" coupling fashion. With flow control valve assembly resting on a bracket assembly and "plug-in" lines between the flow control valve assembly and the "T" valves removal of the flow control valve assembly is facilitated.

Base assembly and drain assembly may be made of molded plastics in ways known in the art. Urns may be of stainless steel and typically would include indicia associated with either the urns or the handles indicating flavors associated with each of the "T" valves. Urn assembly 10 is placed in a user friendly location, typically near cups and an ice making machine. The individual urns dispense individual beverages, which beverages may be carbonated, non-carbonated juice, tea, coffee or the like.

Typically, nozzle 36 is removable from the valve for cleaning and the like. The drip tray assembly may be detachable from the rest of the base for easy emptying and/or may include a drain line therefrom. The drip tray assembly 24 may be adapted to simply rest adjacent the base (see FIG. 7A). The modular design illustrated may receive two, three, four or more urn assemblies each with an associated "T" valve, flow control valve assembly and plumbed for dispensing typically a different beverage each therefrom.

It is to be appreciated that the view of the figures illustrate, at least externally, that there are no electronics involved with the dispensing function. That is to say, typically there are no LED displays, no pressure sensitive electronic switch, no electrical lines or the like coming therefrom. With the lack of electronics (in a preferred embodiment) and in any embodiment the external appearance of a lack of electronics, psychologically the multiple urn and T shaped handles set the consumer to thinking, at least subconsciously, "pre-mix/fresh brewed beverage." Thus, Applicant's novelty lies, in part, on what it omits (features associated with electronics) from traditional post-mix assemblies, the omissions helping to convey the appearance of fresh brewed premix beverages.

While the term flow control valve assembly 50 as set forth above states that it typically includes a flow control valve for each of the water line and the syrup line, and typically includes a shutoff valve for each of the water line and the syrup line, it is to be understood in these specification and claims that the use of the word "flow control valve assembly" may indicate that there is simply a flow control valve for each of the water and the syrup, each of which would be within an urn, or may be mounted externally typically out of sight from the front wall (near the back of the urn, in the base, or under the counter or support surface, etc.).

Further, while multiple urn assemblies are illustrated, wherein each urn of the multiplicity of urns defines an interior volume, which interior volume is not shared with the adjacent separate urns of the urn assembly, it is to be understood that an urn assembly may be an assembly where the side walls of the interior urns and the interior side walls of the two end urns of the urn assembly may in fact not be present so as to define a common interior volume to the wall of the multiplicity of urns.

Figure 6:
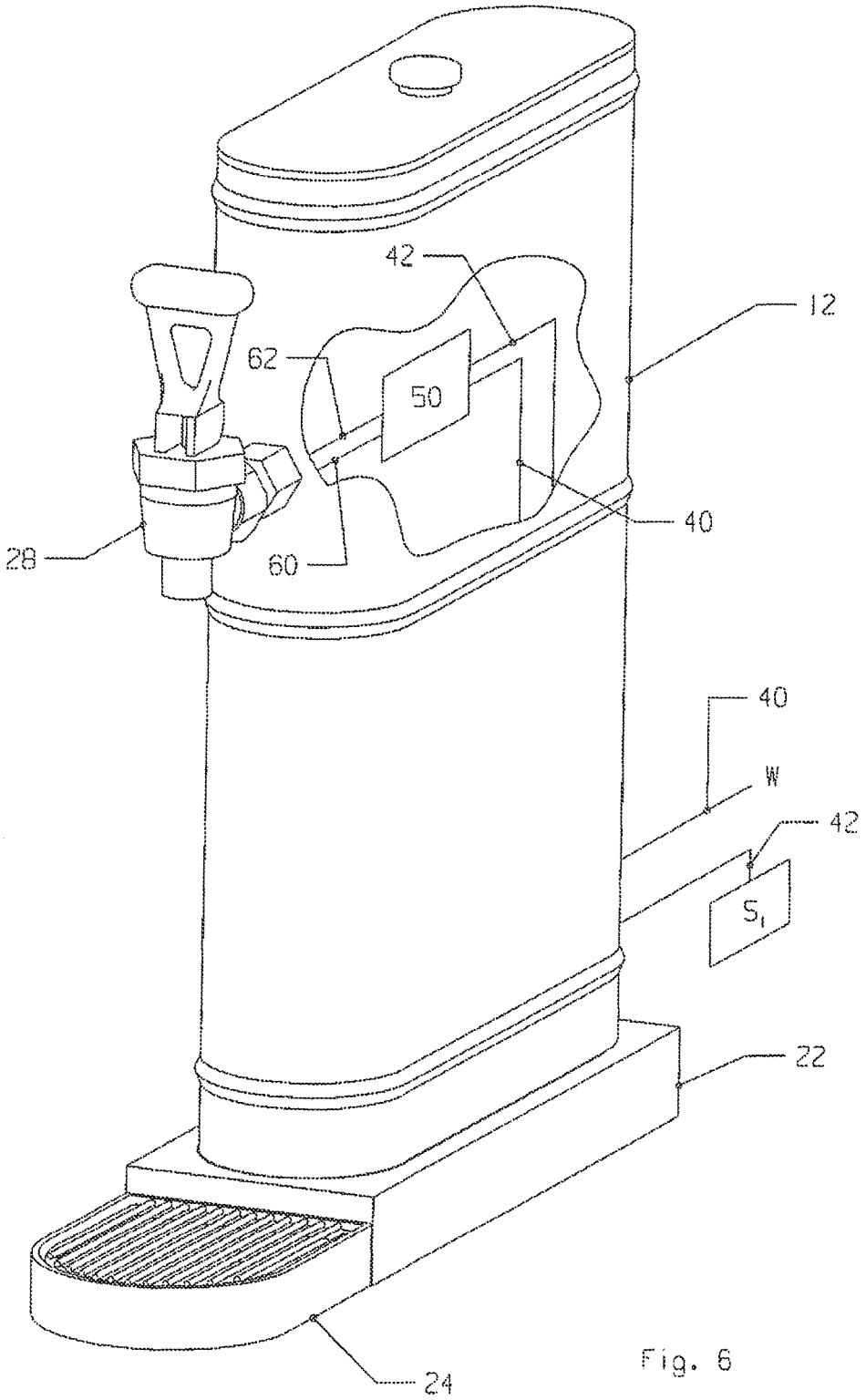
FIG. 6 provides an alternate preferred embodiment of Applicant's present invention, in perspective, which embodiment includes a single urn having a base.
Figure 7A:
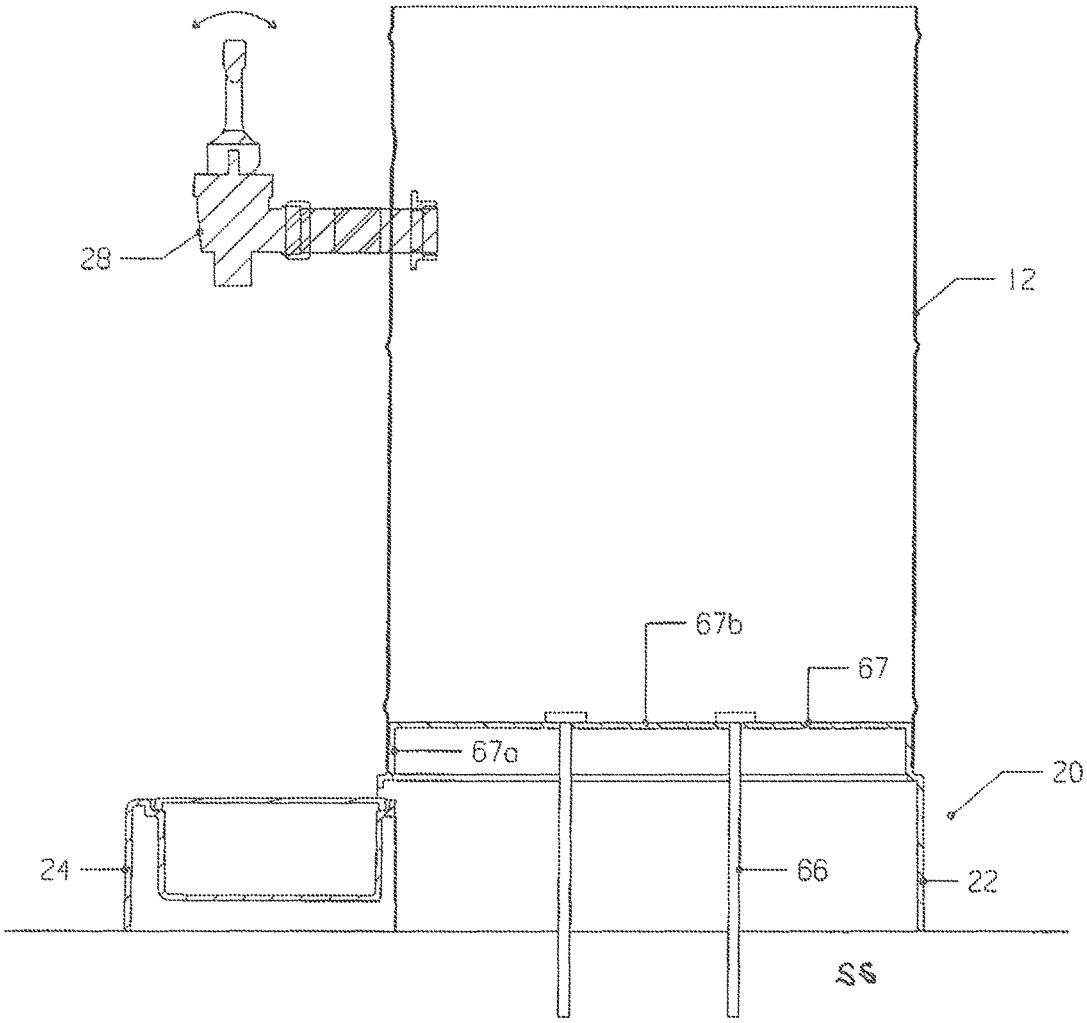
FIG. 7A illustrates base walls for engagement of the urn or urns.

With respect to FIG. 6, it is seen that Applicant may include an embodiment which includes a single urn, set forth in FIG. 7A, with a base, or a single urn without a base and with a support bracket attached to the inside walls of the urn(s) and fasteners engaging the bracket and a support surface.

Turning to FIG. 6, it is seen that when a single urn 12 defines an embodiment then a manifold 41 is not used. Water line W may enter the urn in any fashion and typically will connect to a flow control valve assembly (if it is within the urn). S1 is typically remotely located from the single urn as it is from the urn assemblies and the single urn will receive syrup, pressurized as in all embodiments, and deliver such pressurized syrup to the flow control valve assembly 50. The flow control valve assembly 50 will have output lines for water 60 and syrup 62 to flow to the post-mix T-valve dispenser 28 as illustrated.

With regard to FIG. 6, it is seen that a base, and optionally, a drip tray is provided, but a single urn may be provided without the base, and the base may be with or without a drip tray in all embodiments. It is to be noted that in any of these embodiments, pressurized syrup lines may enter the urn or urns in any fashion, but typically is done so, so the line or lines will not be visible from the front (valve side) of the urn or urns. Likewise, with the water line or lines.

FIG. 7A illustrates upstanding, urn engaging walls 67 shaped to engage the bottom of the urn to hold it to the base 20 and prevent lateral displacement of the base. Walls engaging the outer walls of the urn may be provided as an alternative. Fasteners 66 may engage the walls to help stabilize the base and urn if the engaging walls 67, which typically have a vertical portion 67*a*, also have a horizontal spanning portion 67*b*.

Figure 7B:
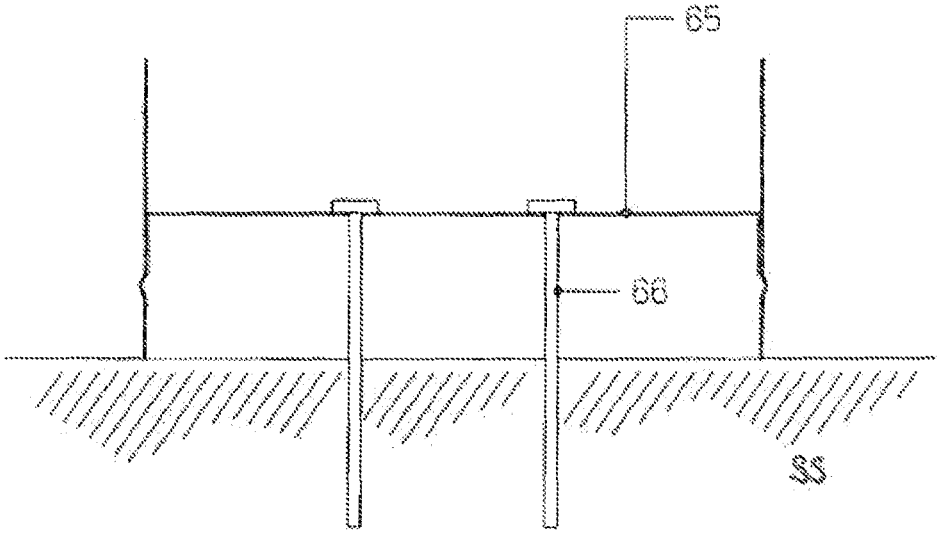
FIG. 7B illustrates an interior urn bracket and fastener assembly for stabilizing an urn with respect to a support surface.

FIG. 7B illustrates how bracket 65 engaging the inner walls of an urn may engage fasteners 66 which extend vertically down to a support surface SS, such as a counter. These will help stabilize the urn or urns as well as a base if one is used.

Figures 2, 3, 4, 5:
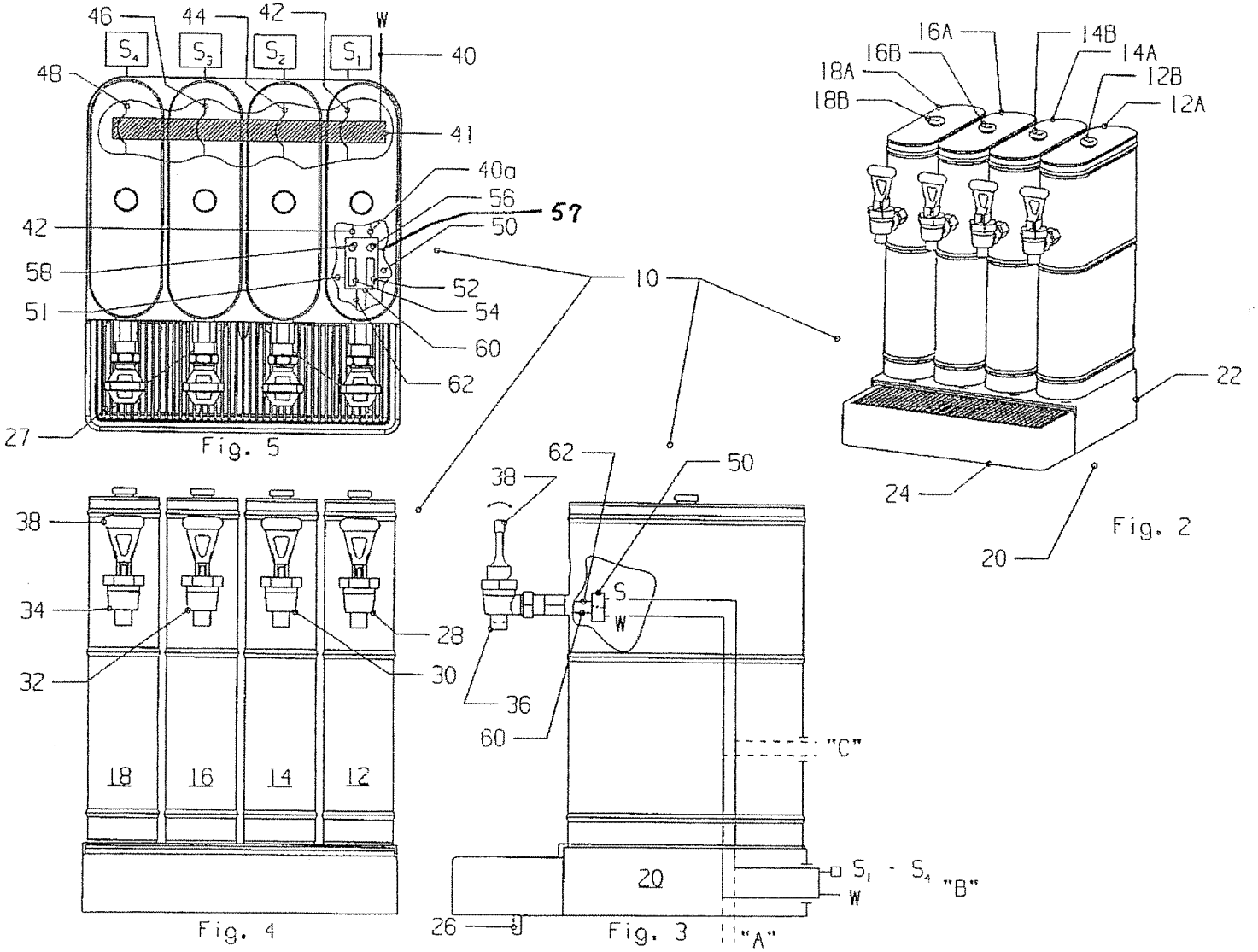
FIG. 2 is a perspective illustration of Applicant's urn assembly comprising of a multiplicity of substantially identical, side by side aligned, urn assemblies.
FIG. 3 is a side elevational view partially cutaway of Applicant's urn assembly.
FIG. 4 is a front elevational view of Applicant's urn assembly.
FIG. 5 is a top elevational view of Applicant's urn assembly illustrating the connection to multiple syrup sources and a water source.
Figure 8:
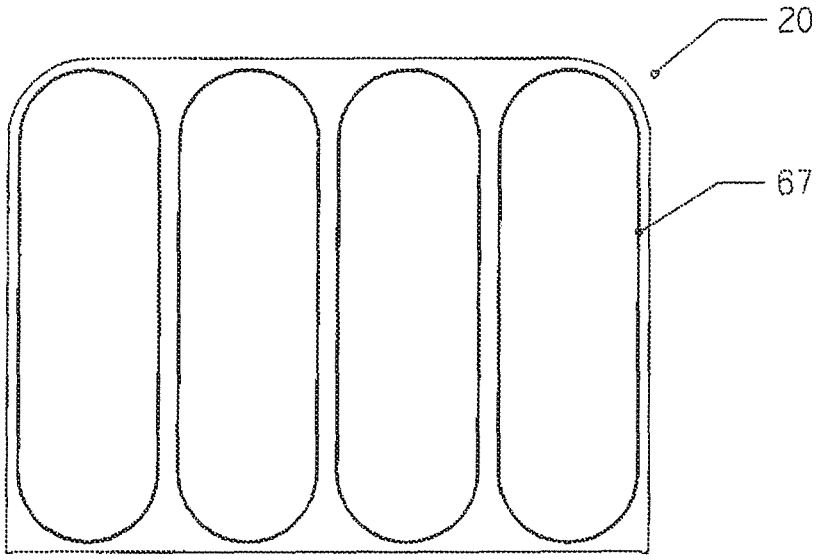
FIG. 8 is a top elevational view of a base showing upstanding base engagement walls for engaging an urn or urns.

FIG. 8 illustrates an elevational top view of a base assembly 20 without the urns thereon, seen here to include upstanding urn engaging walls 67 and capable of holding 4 urns in side-by-side arrangement as seen in FIG. 2, for example.

Urns may be mechanically fastened to a support surface SS with screws, mechanical fasteners 66, glue or the like. Moreover, the urn shape is understood to be shapes other than the oblong shape, including, for example, a cylindrical shape.

The Series 1 FIGS. 9A-9G) illustrate a first embodiment 110 of Applicant's manually operated post-mix dispensing valve which may be used with the urns. It is typically generally "T" shaped (see FIG. 9A).

Generally the dispensing valve is set so that a product delivery assembly 112 is horizontally mounted to the urn or urns. That is to say, product delivery assembly 112 has a longitudinal axis "B". That longitudinal axis B engages a main body 114, which has a vertical axis "A" perpendicular to the product delivery assembly 112. Extending generally upward from main body 114 is valve assembly 116, including a handle 142 for manually operating the post-mix valve assembly. Extending generally below and on the vertical axis of the main body is a diffuser nozzle assembly 118.

Turning back to product delivery assembly 112, whose function it is to deliver product, typically a first and a second fluid to main body 114, it is seen to have a first fluid line 120 and a second fluid line 122. At the removed end of the first fluid line is plug-in member 120A and at the removed end of the second fluid line 122 is plug-in member 122A. Structurally and functionally both plug-ins 122A/122B are configured to fluidly couple the fluid lines 120/122 to the main body and may include O-rings. A holding plate 124 is seen to contain four openings, two of which are designed to snugly receive and encircle fluid lines 120 and 122, and the other two to receive fasteners 126. Holding plate 124 will hold the plug-ins into the main body as seen in FIG. 9D, and fasteners 126 will secure holding plate 124 to the main body as seen in FIG. 9C. Lastly, a connector assembly 128, including a connector nut 128A may secure sheath (optional, not shown) or other tubular member, which may enclose the fluid lines, to main body 114 as seen in FIGS. 9B and 9D.

Turning now to main body 114, it is seen to have a first bore 130 and a second bore 132. First bore 130 includes a bore seat 130A and second bore 132 includes a bore seat 132A. There is a first fluid channel 134 (upstream) of first bore 130 and a first fluid channel 136 (downstream) of bore seat 130A. Likewise, there is a second fluid channel 138 (upstream) and a second fluid channel 140 (downstream) separated by second bore seat 130B.

Main body 114 may include first and second housing portions 139A and 139B, whose function is primarily aesthetic. Main body 114 also includes threaded sections 133 and 135, and nozzle engaging portion 137. The function and structure of these elements is apparent from this specification and the drawings.

Turning now to valve assembly 116, it is seen that valve assembly contains some moving parts and non-moving structure and whose function is primarily to valve pressurized fluid in as supplied by the first and second fluid lines 120/122 to the first and second bores 130 and 132 and into the nozzle assembly. The valve assembly includes a handle 132 secured through a pin 144 to a valve guide and base 146. Valve guide and base 146 will secure the handle with the pin and will provide bores or guides 146A and 146B to receive first valve stem 150 and second valve stem 152. Valve guide and base 46 is secured to main body 114 through the use of threaded cap 148. Valve stems 150/152 have first ends 150A/152A, respectively, valve stem heads 150B/152B, and valve stem seats (elastomeric) 150C/152C. Pin 144 holds and engages first ends 150A/152A to handle 142, and handle 142 to valve guide and base 146. Springs 154 engage the upper surface of stem heads 150B/152B, and engage the underside of valve guide and base 146 to urge the valve stems 150/152 into a seated position as best seen in FIG. 9D with the elastomeric seats 150C/152C snugly and fluidly sealing onto valve stem heads 150B and 152B (see FIG. 9D). In such a position, upstream first fluid channel 134 is sealed from downstream first fluid channel 136 as it is upstream second fluid channel sealed from downstream second fluid channel. O-rings 156 engage stem heads 150B/152B as illustrated. When the handle is pivoted on the pin, both stems 150/152 are unseated (lifted) and fluid flows into the nozzle assembly.

The function of valve assembly 116 is to simultaneously valve a first fluid and a second fluid coming from the product delivery assembly 112. The valve assembly will deliver the fluids to the diffuser nozzle assembly 118.

Diffuser nozzle assembly 118 typically consists of four pieces; a base 158, a first diffuser plate 160, a second diffuser plate 162, and a housing 164. The function of base 158 is, in part, to attach the housing 164 to the dispensing valve 110 and to direct the first and second fluids as set forth more specifically below. The function of first diffuser plate 160 is, in part, to take a first fluid and redirect it from vertical channel flow to horizontally spread out radial flow as set forth more specifically below. The function of second diffuser plate 162, in part, is to take a second fluid and direct it from primarily vertical channel flow to horizontal spread-out radial flow, basically similar to the first diffuser plate. This fluid flow is set forth in FIG. 9F. The function of housing 164 is, in part, to contain and substantially enclose the base and the two diffuser plates and to provide an inner surface for mixing of the first and second fluids thereupon, and further to direct the mixed fluid out of the diffuser nozzle assembly 118.

Base 158 includes a first channel 158A in fluid connection with first fluid channel (downstream) 136 of the main body. Base 158 also includes a second channel 158B in fluid communication with second fluid channel (downstream) 40 of the main body. Channels 158A and 158B will communicate their respective first and second fluids to first diffuser plate 160 as set forth below. Base 158 also includes an outer surface 158C, which outer surface includes housing engagement guides 158D. Outer surface 158C fits snugly within the inner surface of housing 164 and mounting stubs 164D on the inside wall of the housing and are dimensioned and located to receive and ride on guides 158D to snugly hold the upper lip of the nozzle housing 164 in the position indicated in the Series 1 Figures and against elastomeric seal 157.

First diffuser plate 160 typically includes a convex floor 160A and a multiplicity of spaced apart uprights 160B along an outer perimeter or rim 160D thereof. The uprights are separated from one another and create a series of small gaps 160C. The gaps are located along the rim 160D. Rim 160D has a diameter less than the inner diameter of the nozzle inner wall which is adjacent to the rim. Fluid from first channel 158A (the removed end of which the spaced apart from and above floor 160A) will strike the central area and uppermost part (apex) of the convex floor 160A and spread out in a radial pattern horizontally to rim 160D. First fluid will find its way through gaps 160C and onto the inside wall of housing 164 where, under the impetus of gravity and fluid and pneumatic pressure, it will cascade, "waterfall-like" down the inside surface of housing, more particularly, on the inner surface of middle portion 164*b* of housing 164. Middle portion 164B is seen to converge, that is to say, funnel and accelerate the cascading first fluid toward end or nose portion 164C.

It is also seen that first diffuser plate 160 includes a through channel 160E. The through channel 160E couples with the lower end of second channel 158B of base 158. That is to say, unlike first channel 158A of base, which is spaced apart above floor 160A of first diffuser plate, second channel 158B of base physically contacts with through channel 160E of first diffuser plate to carry the second fluid through the first diffuser plate and dump it onto floor 162A of second diffuser plate, where it may spread into a multiplicity of radially spaced ports 162B along rim 162C of second diffuser plate 162. Again, we have pressure release of the second fluid onto the second diffuser plate and out the ports similar to the pressure release of the first fluid. Rim 162C has a diameter less than the inner diameter of the nozzle housing 164 which is adjacent to the rim. The second fluid will pass through the rim located ports onto the inner surface of housing 164 and mix with the cascading first fluid. The mixed fluids will accelerate along the funnel-shaped middle portion 164B and out nose portion 164C, where they are direct into a container for serving a patron.

Figure 9A:
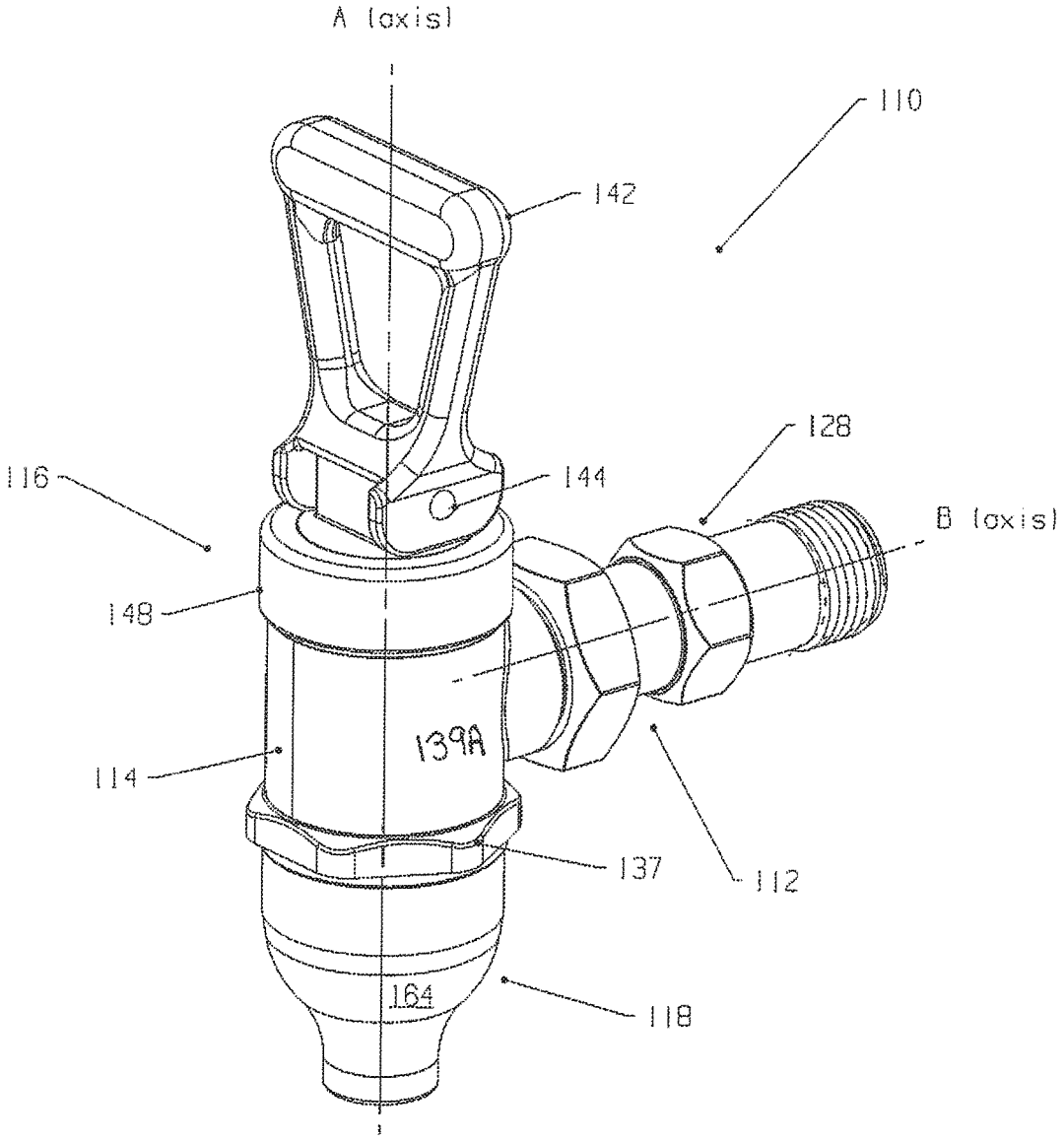
FIGS. 9A, 9B, 9C, 9D, 9E, 9F, and 9G illustrate a first embodiment of a manually operated post-mix dispensing valve.
Figure 9B:
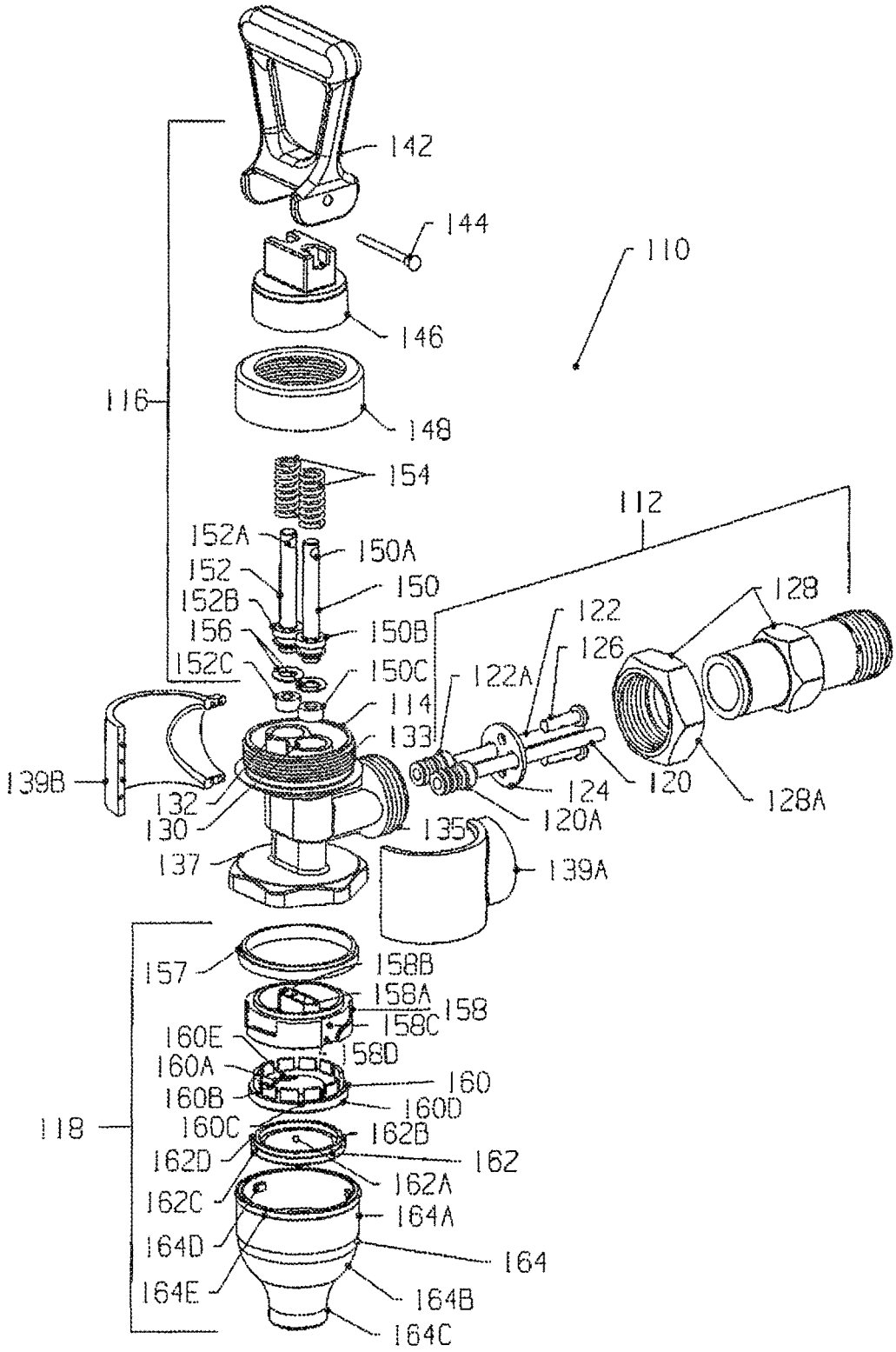
Figure 9C:
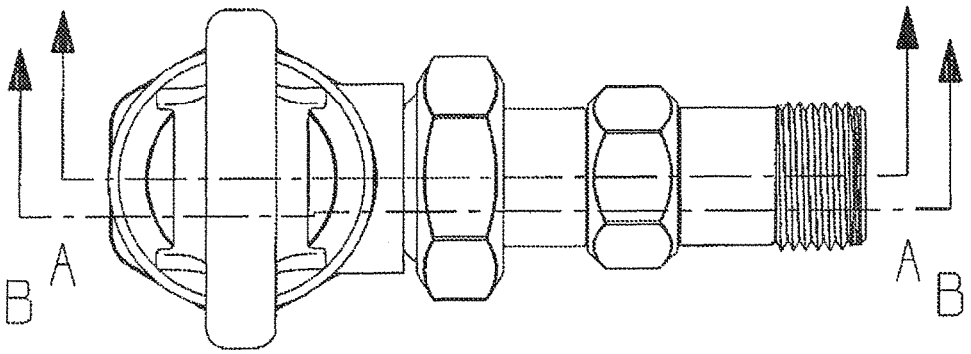
Figure 9C:
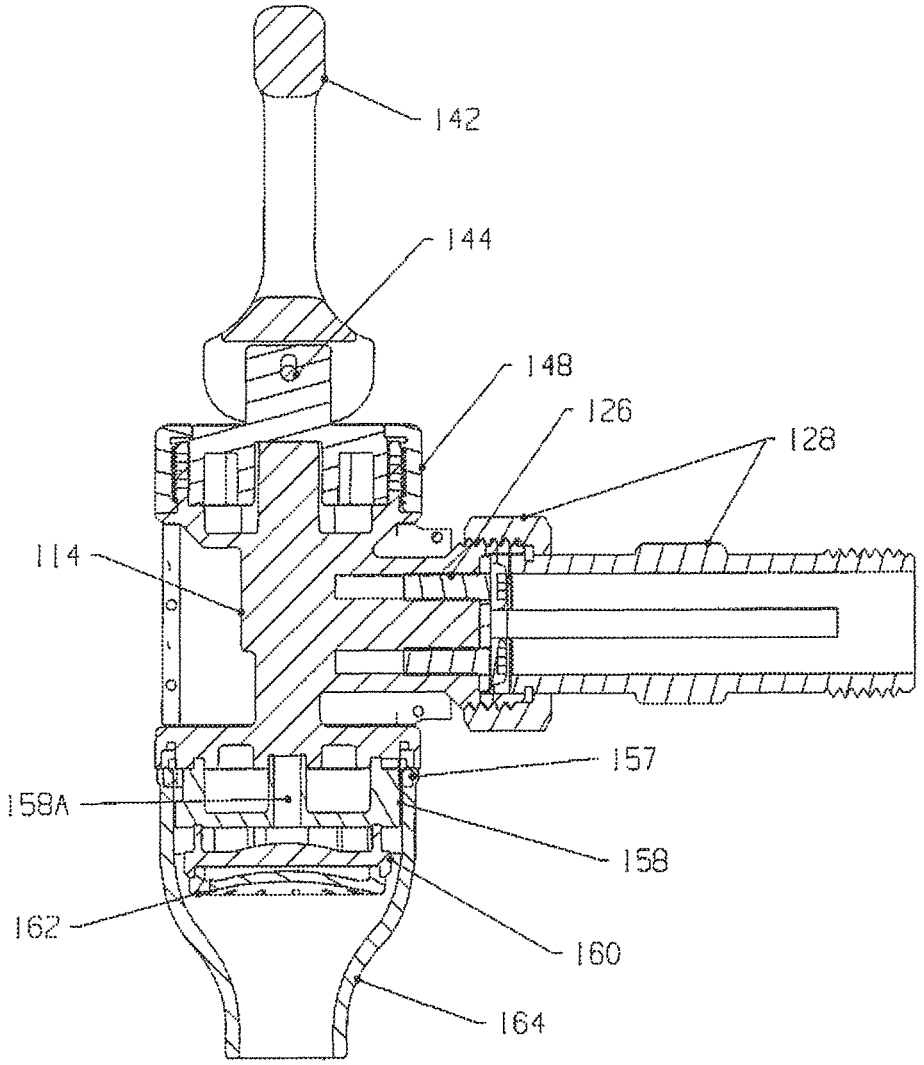
Figure 9D:
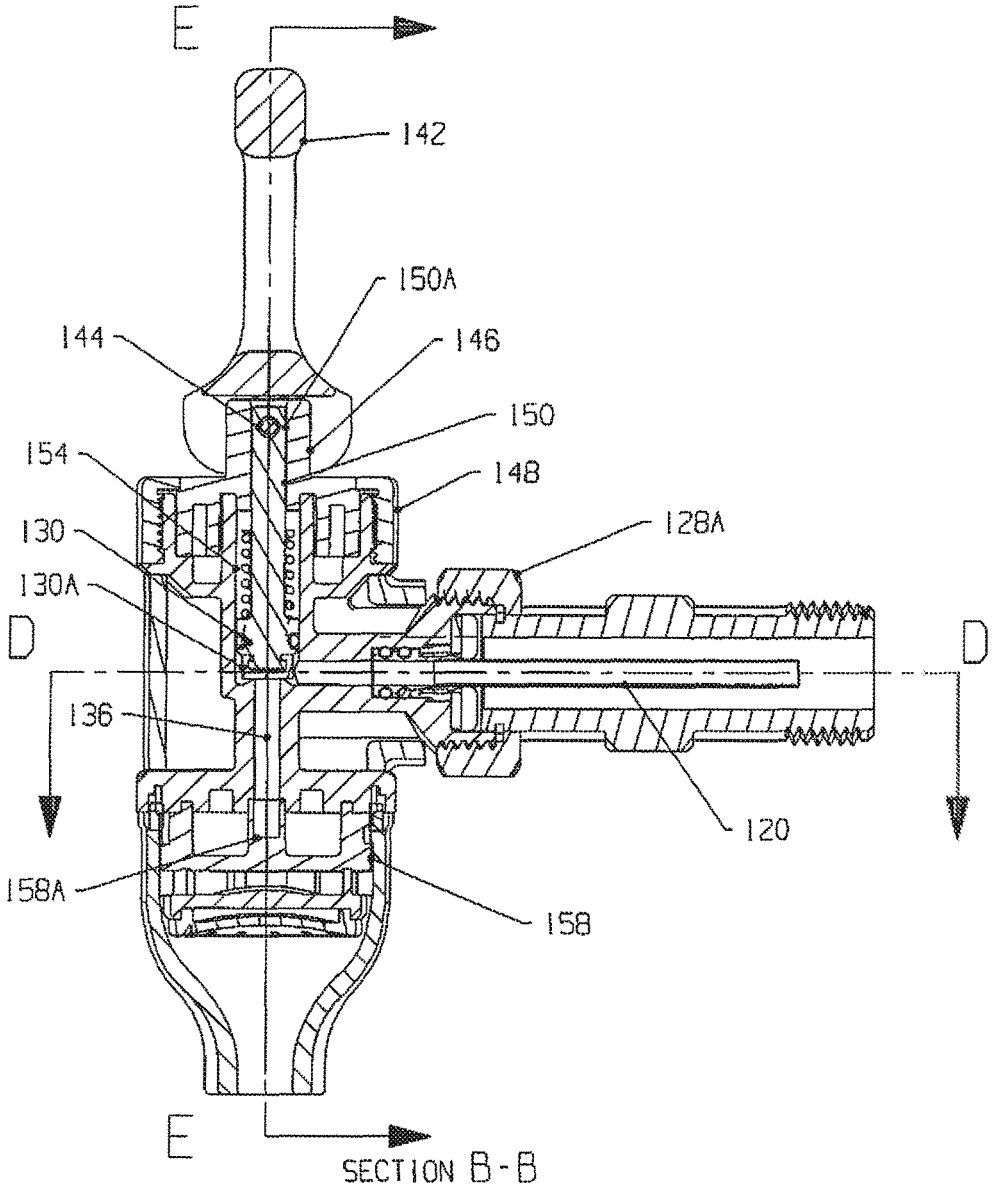
Figure 9E:
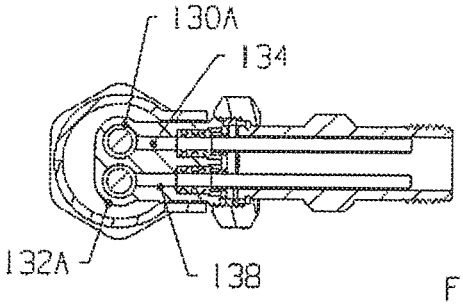
Figure 9F:
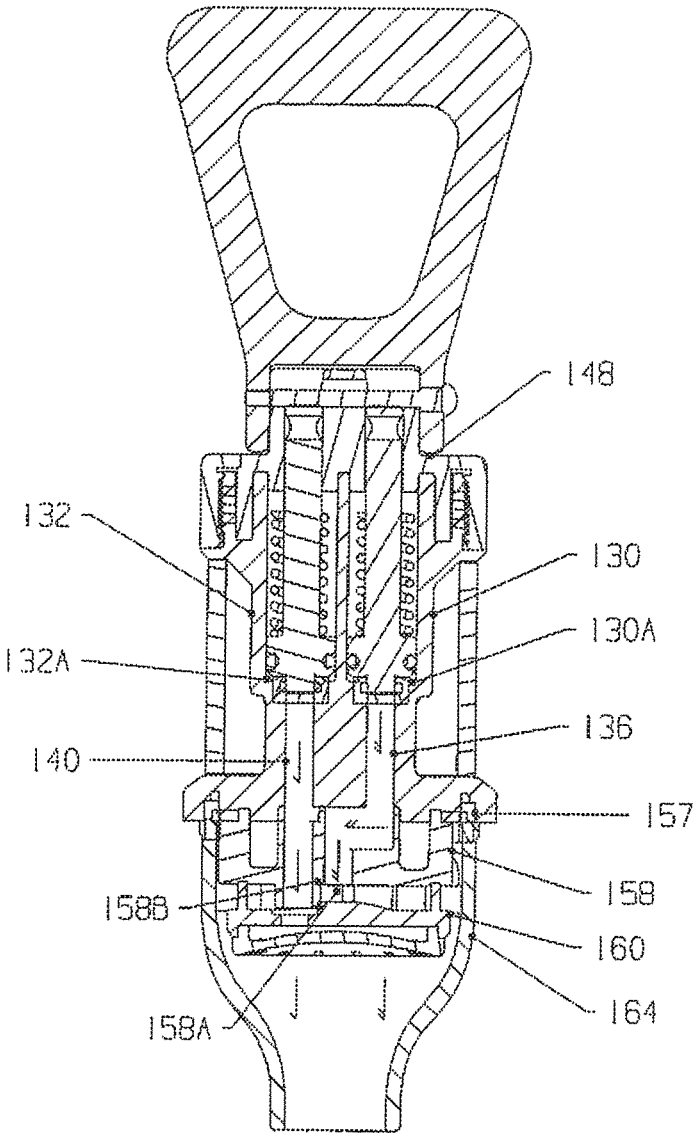
Figure 9G:
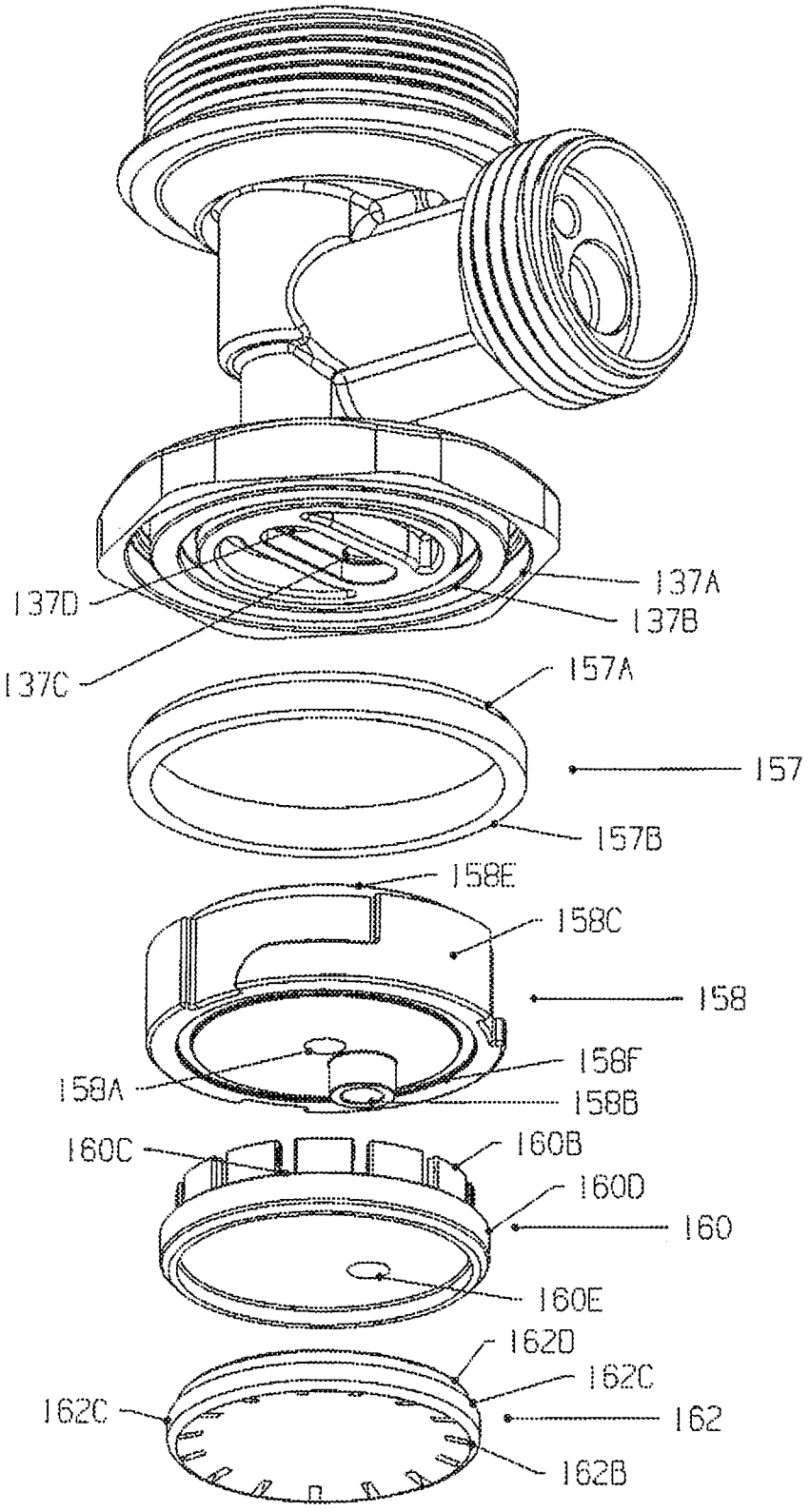

FIGS. 9B, 9F, and 9G illustrate the manner in which the first fluids and second fluids emerge from valve body port 137C (at the removed end of first fluid channel 136) and valve body port 137D (at the end of second fluid channel downstream 140) engage the first channel 158A of base 158 and second channel 158B of base 158, respectively. Note in FIGS. 9C, 9D, and 9F, how first channel 158A brings the fluid therein to a central position over the floor 160A of the first diffuser plate 160. Note second channel 158B carries fluid to through channel 160E, but these are offset from the longitudinal axis of the diffuser nozzle assembly 110. It is also seen how elastomeric seal 157, having an upper lip 157A, will seat into first groove 137A of nozzle engagement portion 137. Base 158 has an upper lip 158E that can be glued or sonically welded into second groove 137B and when housing 164 is rotated onto base 158, upper lip 164E will contact and slightly compress lower rim 157B for a fluid sealing engagement. Groove 158F on the underside of base 158 is dimensioned to receive the removed ends of uprights 160B.

Further details of the present invention, including the nozzle assembly, may be appreciated with reference to U.S. patent application Ser. No. 12/286,441, to the extent of the use of the first diffuser plate and the mixing of the fluids on the inside wall of the nozzle, and other features not inconsistent with the embodiments disclosed.

Turning now to the Series 2 illustrations (FIGS. 10A-10I), it is seen that a second embodiment of Applicants' Tea valve has the same general perpendicular relationship between axes A and B as seen in FIG. 9A. The second embodiment illustrates a valve with some similarities and some differences from the first embodiment. Similarities lie in part in the general "T" shaped construction, that is, with the axis of the handle, valve stems, and nozzle generally along a first axis A and the fluid connection assembly generally along a second, perpendicular axis B. Moreover, the relationship of the valves disclosed (either embodiment) to an urn or urns may be appreciated with respect to FIG. 11. Another similarity is in the construction and function of components of the product delivery assembly 112 and diffuser nozzle assembly 118. Other functional and structural similarities and differences will become apparent with reference to the specifications and drawings.

Turning now to the second embodiment 111 of Applicants' manually operated post-mix dispensing valve as set forth in the Series 2 Figures, Applicants are seen to provide a valve assembly 166, whose function is to manually through operation of handle 1120 activate a pair of valve stems 186 to simultaneously dispense a first and second fluid into nozzle housing 164 as set forth herein.

Figure 10A:
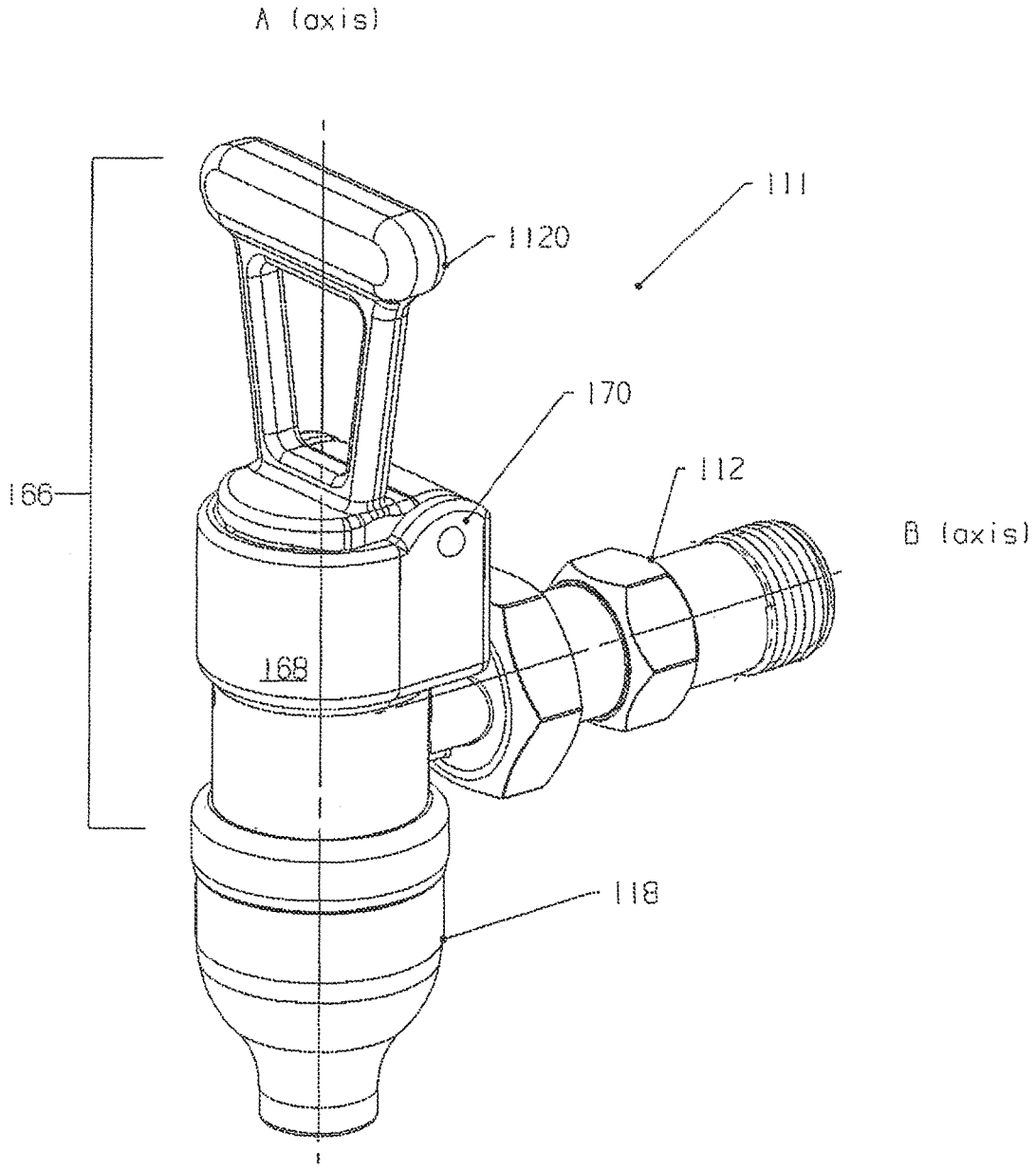
FIGS. 10A, 10B, 10C, 10D, 10E, 10F, 10G, 10H, and 10I illustrate a second embodiment of a manually operated post-mix dispensing valve.
Figure 10B:
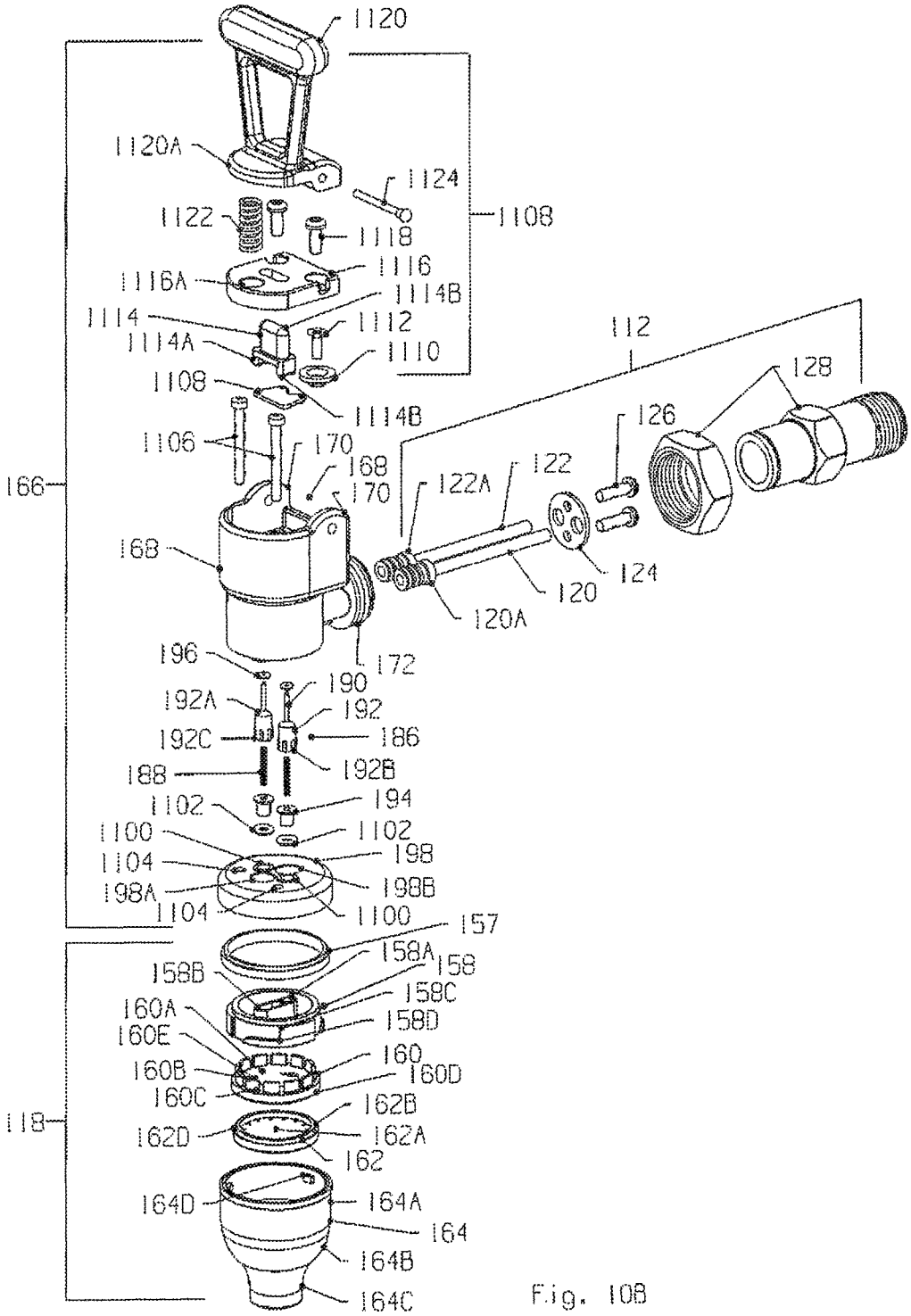
Figure 10C:
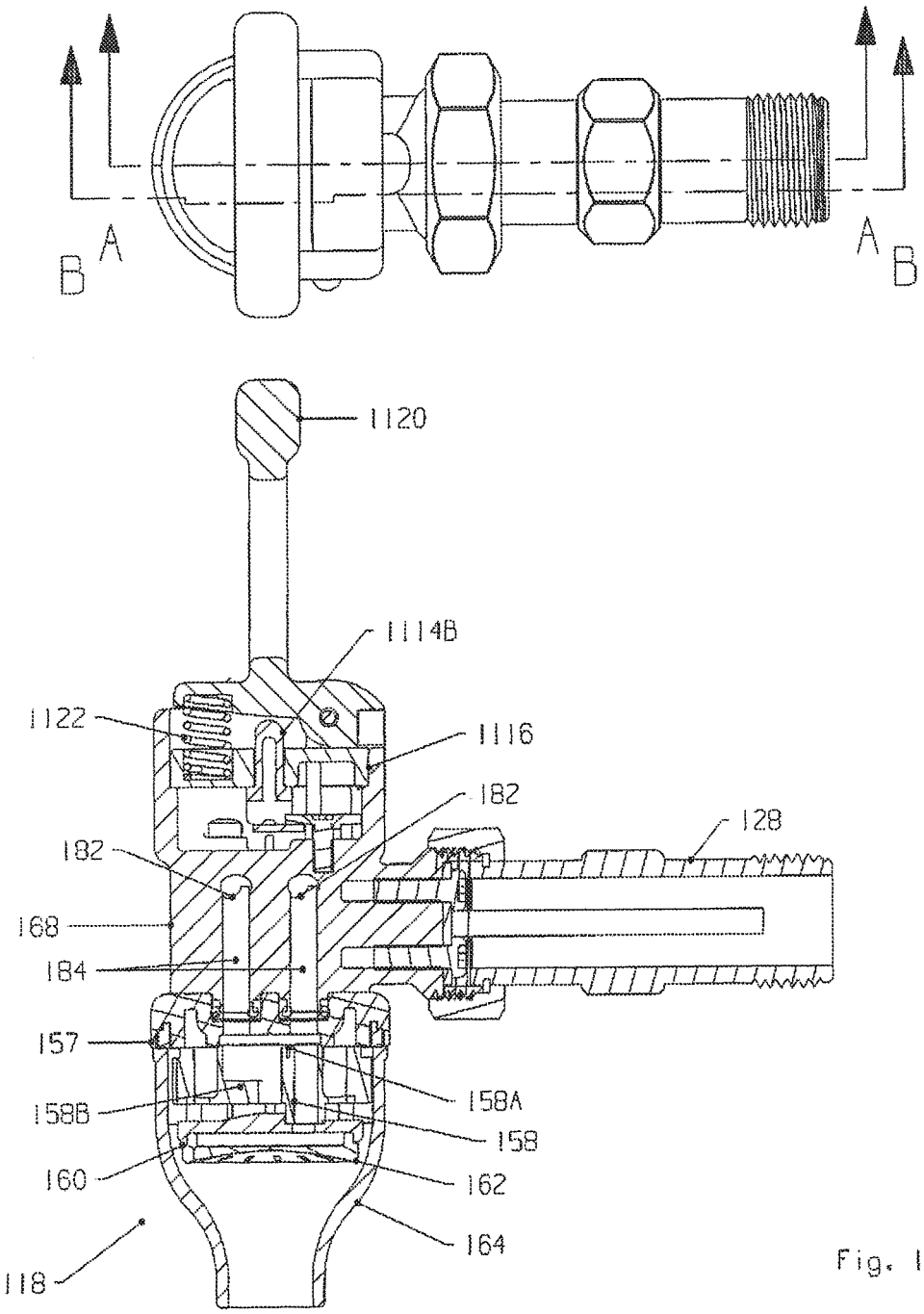
Figure 10D:
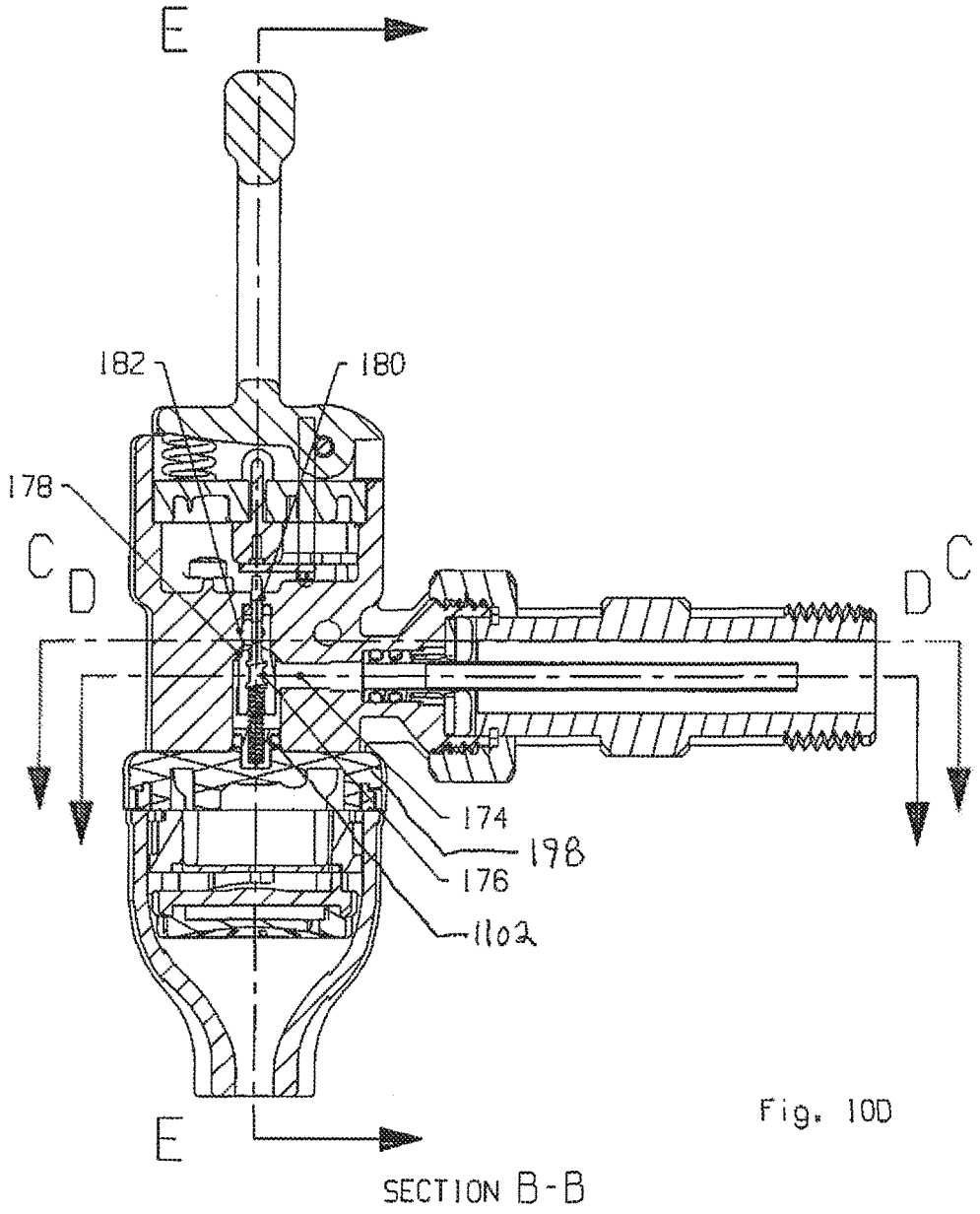
Figure 10E:
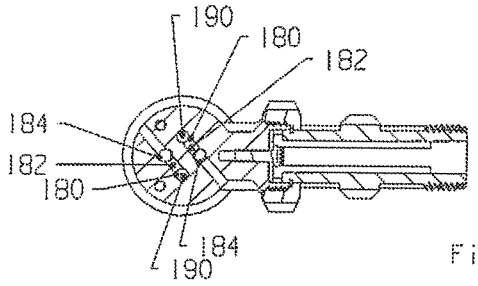
Figure 10F:
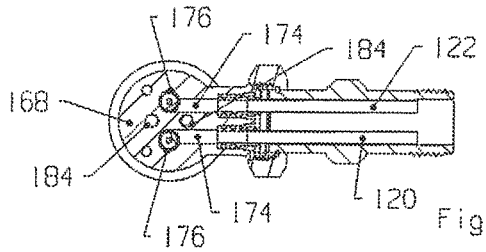

Valve assembly 166 is seen to comprise a body 168 having engagement ears 170 for pivotal engagement of handle 1120 through the use of retainer pin 1124 as best seen in FIG. 10B. A threaded section 172 of body 168 is seen to engage connector assembly 128 as set forth in first embodiment 110. A pair of inlet channels 174 (see FIG. 10F) is provided for fluid coupling with first fluid line 120 and second fluid line 122, respectively. These two inlet channels 174 are each in fluid communication with a pair of piston chambers 176 as seen in FIG. 10F. At the upper portion of the piston chambers is a curved chamber seat 178 dimensioned to receive in flush relation upper end 192A of stem body 192 of each of the two valve members 186. Valve stem bodies 192 may be elastomeric or somewhat pliable so that under urging of springs 188 (and upstream fluid pressure in the piston chamber), urging valve members 186 upward as seen in FIG. 10B (when the handle is in the non-use or valve (normally) closed position as seen in FIG. 10B). Upper ends 192A will seat against chamber seat 178 and, indeed the hydraulic pressure of the fluid in lines 120/122 will urge valve members 186 into a normally closed position. This will help prevent leakage around the seats when the valve is in the normally closed position.

Valve stem guides 180 in body 168 are dimensioned to snugly receive valve stems 190 to guide the vertical movement of the stems up and down as they open and close. Moreover, valve body 192 includes, near a lower end 192C thereof, ribs 1928 that will provide for the snug receipt of valve members 186 in piston chambers 176 as well as allowing fluid to pass between stem bodies 192 and the walls of the piston chambers. In FIG. 10F, it is seen that stem guides 180 provide for the maintenance of valve members 186 in body 168.

When handle 1120 is pivoted forward from its normally closed upright position, it is seen that spring 1122 will be compressed and connector member 1114, being urged by the underside of handle 120, will depress the removed ends of valve stems 190. This action will unseat the valve members 186 and allow fluid to pass into the nozzle assembly 118.

Turning to the details of the actuation of the handle and its structure and function, it is seen that retainer pin 124 allows the handle to pivot forward, typically about 15-20°. Furthermore, it is seen that upper base 1116 may be engaged body 168 through the use of threaded fasteners 1118. Upper base 1116 provides a seat 1116A for spring 1122, which is normally under compression against the underside of handle 1120 as seen in FIG. 10B. A pair of legs 1114A and 1114B couple the connector member 1114 to a pivot plate 1108. Pivot plate 1108 is retained to body 168 through the use of a pivot plate hold-down 1110, which will maintain pivot plate 1108 on body 168 with the underside of the pivot plate in contact with the removed ends of valve stem guides 190 and with the upper surface of pivot plate 1108 contacting legs 1114A and 1114B. This couples, through the pivot action of handle 1120, a linear movement of connector 1114 to a pivoting movement of pivot plate 1108, which in turn transmits a linear movement, simultaneously to the two valve stems 186, seating both simultaneously and allowing fluid to flow through body 168.

Fasteners 1118 are used to secure upper base 1116 to body 168. Fastener 1112 is used to secure pivot plate 1108 to body 168. Upper base 1116 is seen to include a slot 1116B to engage the upper portion 1114B of connector 1114 and maintain it adjacent the lower portion of base 1120A of handle 1120. Fasteners 1106 are seen to engage threaded portions 1104 of lower base 198 to body 168 as seen in FIGS. 10B and 210.

Turning to fluid flow (and with reference to FIGS. 10C, 10E, 10F, and 10G) from first and second fluid lines 120/122 to nozzle assembly 118, reference is made to the following. Each chamber seat 178 is fluidly coupled to a crossover channel 182 and each crossover channel is coupled to a down flow channel 184. Down flow channels 184 terminate at lower base 198, which is sealed to body 168 and provides through channels 198A and 198B (each an extension of a flow channel) for passage of first and second fluid into channels 158A and 158B (each an extension of 198A and 198B, respectively). Flow through the diffuser nozzle assembly 118 is then the same as set forth in the first embodiment.

Figure 10G:
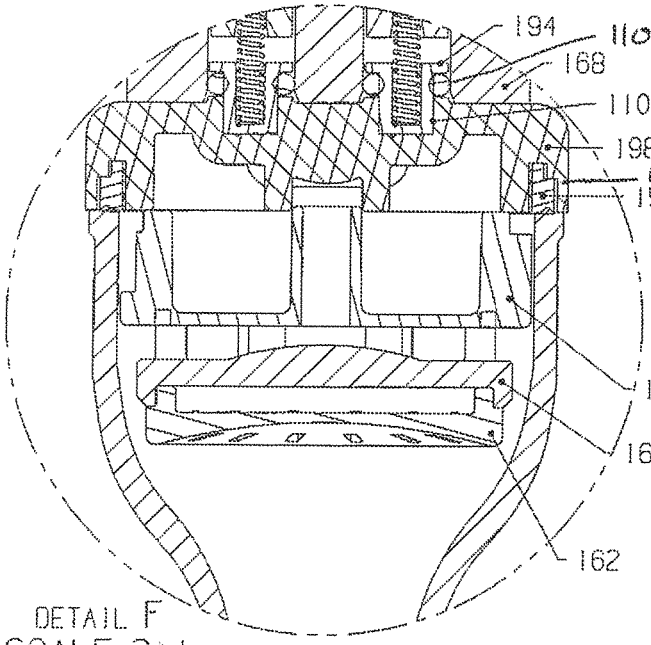
Figure 10G:
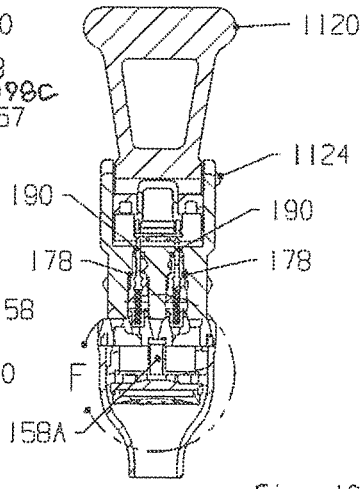
Figure 10H:
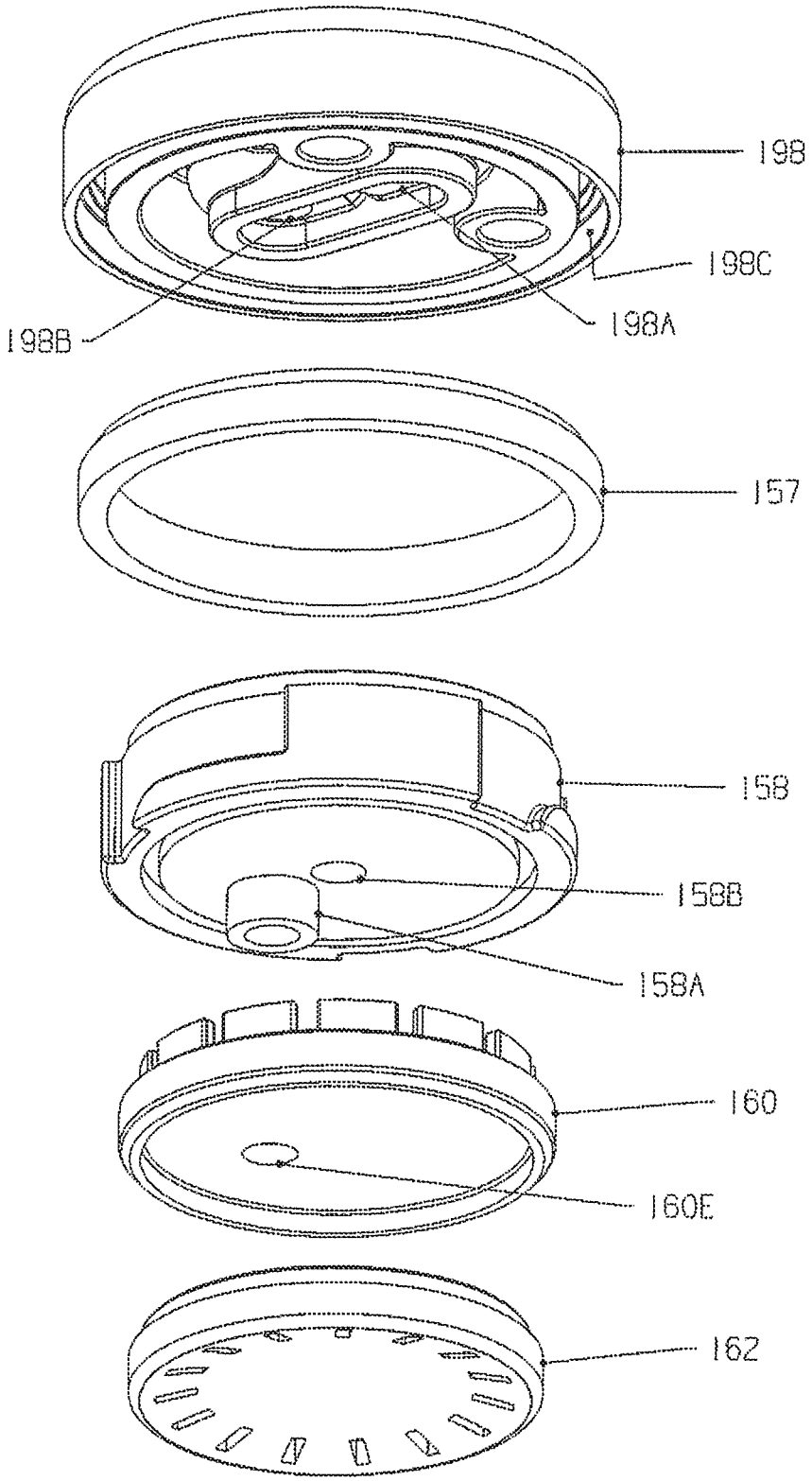
Figure 10I:
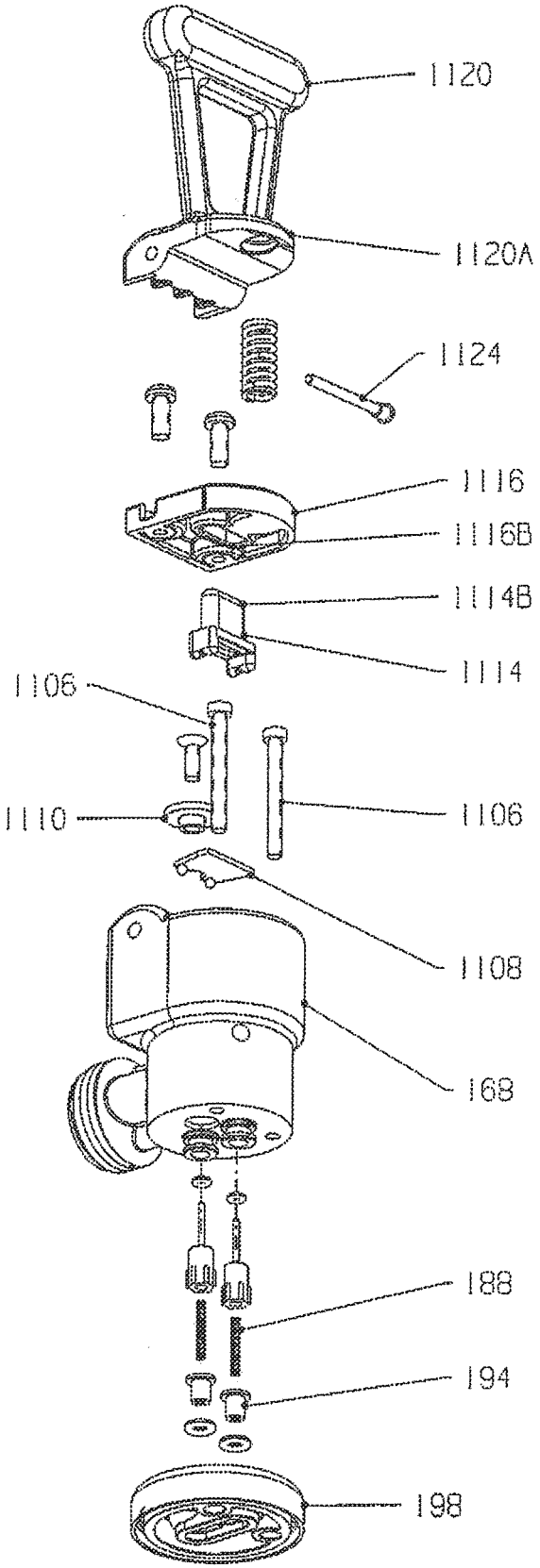

Turning back to lower base 198, it is seen to have retainer seats 1100 for the receipt of retainers 194 therein. O-rings 1102 are captured by sealing retainers 194 into lower base 198 by slide fit into retainer seats 1100. Retainers 194 therefore are seen to retain O-rings, provide retainment for the lower end of springs 188, and seal the lower ends of piston chambers 176. Springs 188 are compressed between retainer and stem body 192, which typically is partially hollowed out (see FIG. 10I) to receive the removed ends of springs 88; that is, the spring ends opposite those that engage with retainers 194. Detail F of FIG. 10G illustrates the manner in which the elements of the diffuser nozzle assembly engage one another. Lower base 198 is fastened to the bottom of body 168. Elastomeric seal 157 fits into channel 198C (see FIG. 10H). Base 158 is glued or fastened to lower base 198 and first diffuser 160 is glued or fastened to base 158 with second diffuser plate 162 attached to first diffuser plate 160 as illustrated.

Figure 11:
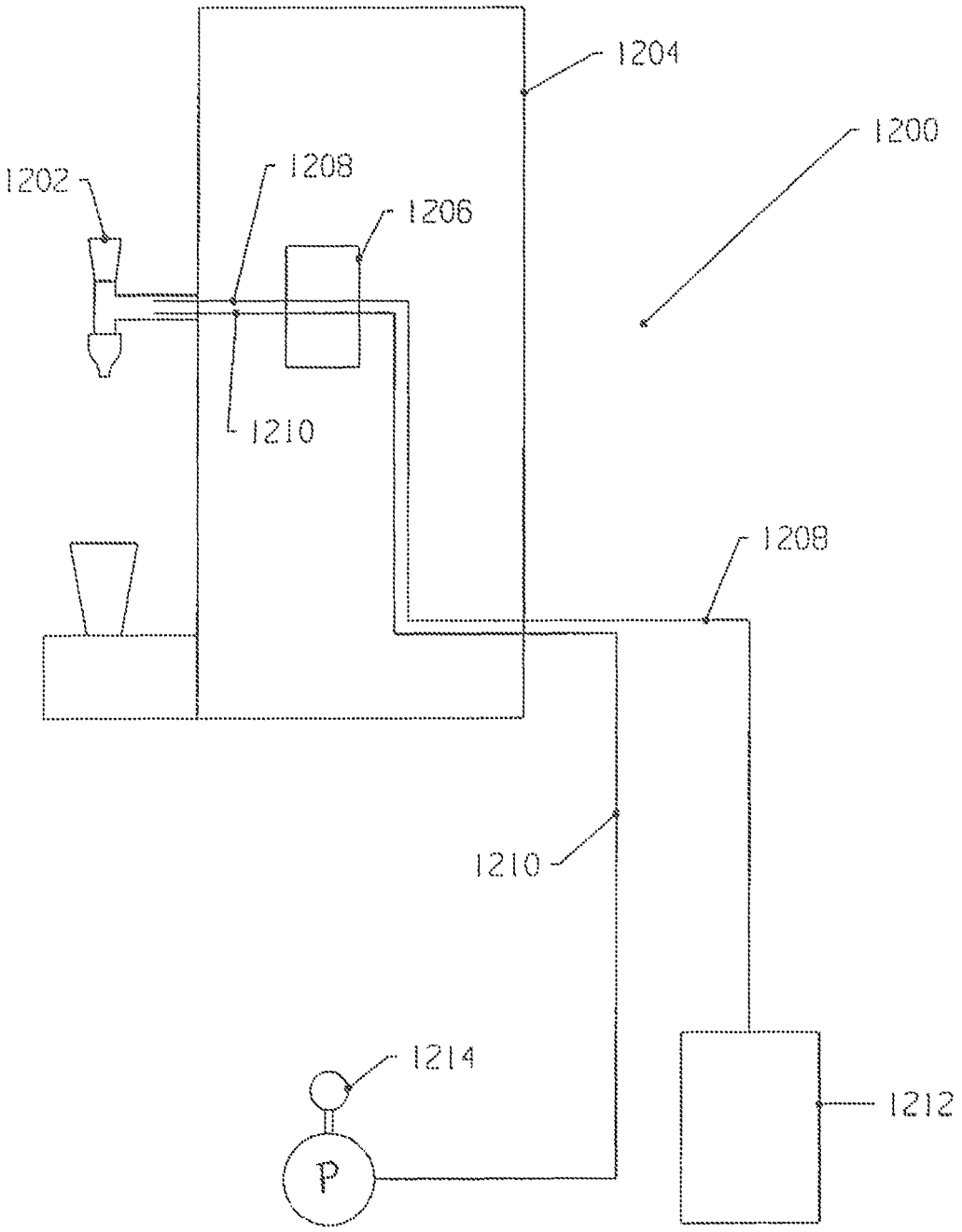
FIG. 11 illustrates in schematic form a system incorporating Applicant's novel manually operated post-mix dispensing valves.

FIG. 11 illustrates a system 1200 which uses any embodiments of the manually operated post-mix dispensing valves set forth herein, including the Tea valves. FIG. 11 illustrates the use of the nozzle valves 1202 in any embodiment illustrated herein in a system using a dummy urn 1204 or a tower, which dummy urn or tower substantially encloses at least part of a syrup 1208 (typically engaging pump P) and/or a water 1210 line there within. Urns and towers are known in the art to have a capability of enclosing something, typically a liquid, but in an embodiment of Applicant's system 1200, the urn 1204 may be "dummy" in that it does not itself contain liquids except as those liquids are found within fluid lines. Indeed, system 1200 as illustrated provides that both the source of the syrup and water are outside the dummy urn, but would appear to a user, especially one that is on the valve side of the dummy urn or tower to be receiving fluids, which fluids are contained within the walls of the urn or tower and not within the lines within the urn. Here, syrup 1208 flows in line from a pressurized source, typically at 65-75 psi, such as in a "bag and box" or other beverage concentrate. Concentrate could also mean at a 1/1 ratio, but is typically in a 3, 4 or 5/1 ratio of syrup (i.e., product) to water and/or soda 210. The source of soda and/or water illustrated in pressure system 1200 is any source known in the art, but here, for example, city water 1214 is provided along with, optionally, a pressure regulator. Between the syrup source and the water source and the valve 1202 (which may be a valve as disclosed herein) is typically found a flow control device 1206, that is to say, a device that can control the flow of either or both the water and the syrup from its source (1212/1214) to the valve. In a preferred embodiment of system 1200, the flow control device is within the walls of the dummy urn, or if used, tower. In a preferred embodiment, the flow control device is a fixed orifice flow control valve.

It is to be understood that the Series I and Series II valves are post-mix mechanical valves that may be used with the urn or urns disclosed herein. Furthermore, both valves are upstream pressurized fluid sources urging a member to a normally closed position. Because of this, a water regulator normally provided to cut water pressure is not necessary.

It should be noted that the handles used in these embodiments are typically lever-type handles, providing a mechanical advantage that multiplies force at the handle end to the stem or piston. It is understood that the term piston also includes the stems of the Series I valves (FIGS. 9A-9G).

Although the invention has been described in connection with the preferred embodiment, it is not intended to limit the invention's particular form set forth, but on the contrary, it is intended to cover such alterations, modifications, and equivalences that may be included in the spirit and scope of the invention as defined by the appended claims. While the two disclosed embodiments are Tea valves, any configuration with two liquids manually dispensed post-mix may be considered within the scope of the embodiment disclosed herein. Moreover, manual operation is intended to include pressing a lever (for example, with a container) such that a post-mix beverage is dispensed into the container. The product delivered out the nozzle assembly may be carbonated (see FIG. 11) or non-carbonated.

The invention claimed is:

1. A beverage assembly, including a non-electrical, manual, post-mix valve for dispensing a beverage, the beverage assembly for mixing and dispensing a first fluid and a second fluid therefrom, the beverage assembly comprising:

an urn having an interior volume and a wall defining an outer wall; at least one pressurized base fluid source not located in the interior volume; at least one pressurized syrup source not located in the interior volume;

a first flow control valve controlling the pressurized base fluid source, and a second flow control valve controlling the pressurized syrup; wherein the flow control valves are mounted interiorly of the urn front wall;

the post-mix valve adapted to engage the outer wall of the urn, and having:

a body comprising a first pressurized fluid channel carrying the pressurized base fluid; a second pressurized fluid channel carrying the pressurized syrup; a first piston and a second piston, each piston including a longitudinal axis along its length; a first piston chamber having a piston seat, the first piston chamber in fluid connection with the first pressurized fluid channel, and a second piston chamber having a piston seat, the second piston chamber in fluid connection with the second pressurized fluid channel;

a first downstream channel, downstream of the first piston seat; and a second downstream channel, downstream of the second piston seat; a handle for engaging an upper portion of the body and extending upward therefrom, the handle adapted to engage the first and second pistons;

wherein the first piston and the second piston each include an upper end, a lower end, and a sealing member that prevents fluid from flowing toward the upper ends;

wherein the handle is moveable between a first position, wherein the pistons are fluidly sealed to their piston seats, and a second position, wherein the pistons are spaced apart from the piston seats linearly along their longitudinal axes and fluid flows from the pressurized fluid channels, past the piston seats, through the downstream channels, and into the nozzle;

a nozzle assembly for engaging the body, the nozzle assembly having a nozzle core, and a nozzle housing with inner walls, the nozzle core for engaging the first and second downstream channels, the nozzle housing for removably engaging the nozzle core; wherein the nozzle core is configured to maintain the first and second fluids separate from one another until mixing on the inner walls of the nozzle housing; and a product delivery assembly removably attached to the body and configured to position the mechanical valve distally from the outer wall of the urn and to route, within the product delivery assembly, a first elongated flexible fluid channel and a second elongated flexible fluid channel to the body from the interior volume of the urn; the first elongated flexible fluid channel carrying the pressurized base fluid from the first control valve and the second elongated flexible fluid channel carrying the pressurized syrup from the second control valve.

2. The valve of claim 1, wherein the nozzle core is adapted to spread the first and second fluids around the inner walls of the nozzle housing.

3. The valve of claim 1, wherein the nozzle core includes a diffuser plate to spread at least one of the fluids of the pressurized fluid channels.

4. The valve of claim 3, wherein the diffuser plate of the nozzle core includes a first diffuser plate to redirect a first fluid from a vertical channel flow to a horizontal flow pattern which is directed towards the inner walls of the nozzle housing.

5. The valve of claim 4, wherein the nozzle core includes a second diffuser plate to redirect a second fluid from a vertical channel to a radial flow pattern which is directed towards the inner walls of the nozzle housing.

6. The valve of claim 1, further including a diffuser plate, wherein the diffuser plate of the nozzle core includes a first diffuser plate to redirect a first fluid from a vertical channel flow to a horizontal flow pattern; and wherein the nozzle core includes a second diffuser plate to redirect a second fluid from a vertical channel to a radial flow pattern.

7. The valve of claim 6, wherein at least one of the diffuser plates has a convex upper surface for receiving a vertical fluid thereon and redirecting such flow to a horizontal flow.

8. The valve of claim 1, wherein the first fluid is deposited upon the inner walls of the nozzle housing higher up on the inner walls than the second fluid.

9. The valve of claim 1, wherein the nozzle housing includes a nose section having a nose opening with a reduced diameter and wherein the core terminates before the nose section.

10. The valve of claim 1, wherein the nozzle housing releasably and toolessly couples to the body.

11. The valve of claim 8, further including an elastomeric member for receipt between the nozzle housing and the body.

12. The beverage assembly of claim 1, wherein the body includes a removable holding plate configured so that the flexible fluid channels are removably retained to the body.

13. The beverage assembly of claim 12, wherein the body is configured so that separation of the body from the product delivery assembly allows the holding plate to be removed while the fluid channels are retained in the product delivery assembly.

14. The beverage assembly of claim 1, wherein the first fluid is pressurized above 60 pounds per square inch.

15. The beverage assembly of claim 1, wherein the post-mix valve includes springs on each pistol, wherein the pistons compress the springs as the pistons are spaced apart from the piston seats.

16. The beverage assembly of claim 15, wherein the pressurized fluid channels are fluidly coupled to the pistons such that when the handle is in the first position the fluid pressure therein urges the pistons against piston seats.

17. The beverage assembly of claim 1, further comprising two or more urns.

* * * * *